US011125476B2

(12) United States Patent
Miyawaki et al.

(10) Patent No.: US 11,125,476 B2
(45) Date of Patent: Sep. 21, 2021

(54) GAS-LIQUID SEPARATOR SYSTEM FOR REFRIGERATION CYCLE APPARATUS

(71) Applicant: Mitsubishi Electric Corporation, Chiyoda-ku (JP)

(72) Inventors: Kosuke Miyawaki, Chiyoda-ku (JP); Yoji Onaka, Chiyoda-ku (JP); Osamu Morimoto, Chiyoda-ku (JP); Hiroyuki Okano, Chiyoda-ku (JP); Takanori Koike, Chiyoda-ku (JP); Hiroki Maruyama, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 50 days.

(21) Appl. No.: 16/481,097

(22) PCT Filed: Mar. 24, 2017

(86) PCT No.: PCT/JP2017/012013

§ 371 (c)(1),
(2) Date: Jul. 26, 2019

(87) PCT Pub. No.: WO2018/173255

PCT Pub. Date: Sep. 27, 2018

(65) Prior Publication Data

US 2020/0271357 A1 Aug. 27, 2020

(51) Int. Cl.
*F25B 41/39* (2021.01)
*F25B 13/00* (2006.01)

(52) U.S. Cl.
CPC ..... *F25B 13/00* (2013.01); *F25B 41/39* (2021.01); *F25B 2313/02523* (2013.01);
(Continued)

(58) Field of Classification Search
CPC ..... F25B 2400/23; F25B 43/006; F25B 2313/0252; F25B 2400/0409
See application file for complete search history.

(56) References Cited

U.S. PATENT DOCUMENTS 4,341,086 A * 7/1982 Ishii ..... F25B 1/00 62/225
9,541,316 B2 * 1/2017 Takeda ..... F25B 43/006
(Continued)

FOREIGN PATENT DOCUMENTS

JP 9-229497 A 9/1997
JP 2004-108715 A 4/2004
(Continued)

OTHER PUBLICATIONS

Extended European Search Report dated Nov. 27, 2019 in European Patent Application No. 17902284.3, 7 pages.
(Continued)

*Primary Examiner* — Frantz F Jules
*Assistant Examiner* — Lionel Nouketcha
(74) *Attorney, Agent, or Firm* — Xsensus LLP

(57) ABSTRACT

A refrigeration cycle apparatus includes a main circuit through which refrigerant circulates and in which a compressor, a condenser, a first expansion device, a centrifugal gas-liquid separator that separates refrigerant into gas refrigerant and liquid refrigerant by using centrifugal force, and an evaporator are connected by refrigerant pipes; and a bypass that returns the gas refrigerant obtained through the separation by the gas-liquid separator to a suction side of the compressor. The gas-liquid separator includes a cylindrical container, an inflow pipe, a gas outflow pipe, and a liquid outflow pipe. The main circuit includes a second expansion device provided between the liquid outflow pipe of the gas-liquid separator and the evaporator. The gas refrigerant discharged from the gas outflow pipe of the gas-liquid separator flows into the bypass, and the bypass is provided with a third expansion device.

21 Claims, 14 Drawing Sheets

(52) U.S. Cl.
CPC ..... *F25B 2400/0409* (2013.01); *F25B 2400/0411* (2013.01); *F25B 2400/23* (2013.01); *F25B 2600/2501* (2013.01)

(56) References Cited

U.S. PATENT DOCUMENTS

| | | | | |
|---|---|---|---|---|
| 2004/0118148 | A1* | 6/2004 | Ther | F25B 43/006 62/503 |
| 2012/0247146 | A1* | 10/2012 | Yamada | F25B 1/10 62/498 |
| 2016/0068047 | A1 | 3/2016 | Kobayashi et al. | |

FOREIGN PATENT DOCUMENTS

| | | | | |
|---|---|---|---|---|
| JP | 2008-75894 | A | | 4/2008 |
| JP | 2009-174836 | A | | 8/2009 |
| JP | 2010-96483 | A | | 4/2010 |
| JP | 2010-181090 | A | | 8/2010 |
| JP | 2010181090 | A | * | 8/2010 |
| JP | 2011-247575 | A | | 12/2011 |
| JP | 2012-202652 | A | | 10/2012 |
| JP | 2014-211265 | A | | 11/2014 |
| JP | 2017-20768 | A | | 1/2017 |
| JP | 2017020768 | A | * | 1/2017 |

OTHER PUBLICATIONS

International Search Report dated Jun. 20, 2017 in PCT/JP2017/012013 filed on Mar. 24, 2017.

* cited by examiner

FIG. 25

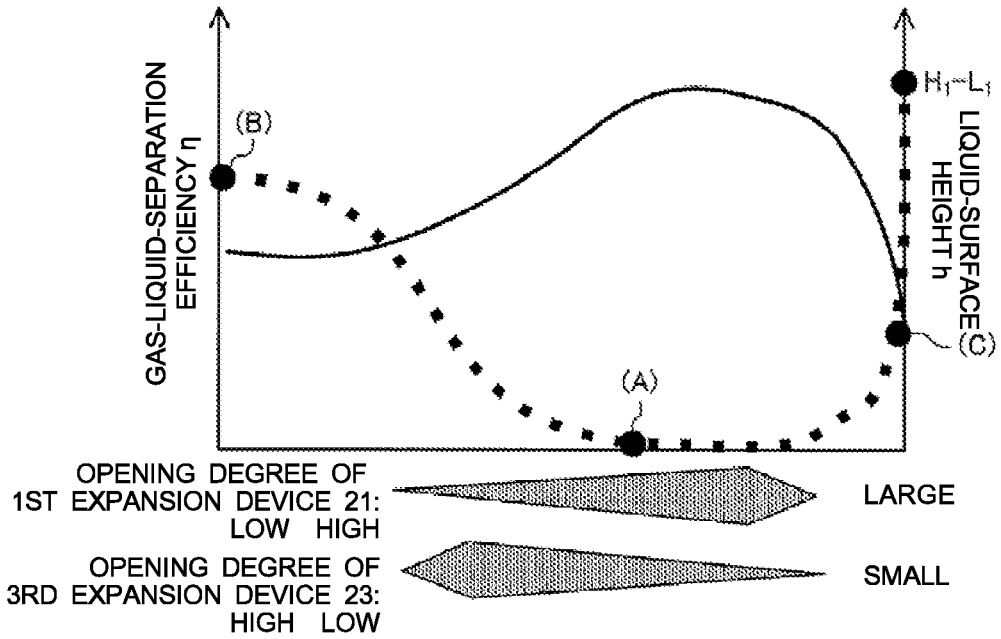

FIG. 26

| EXPANSION DEVICE (NO.) | HEATING ONLY | | COOLING ONLY |
|---|---|---|---|
| | RATED ($Gr_{now} > Gr_0$) | INTERMEDIATE ($Gr_{now} \leq Gr_0$) | |
| 1ST EXPANSION DEVICE (21) | OPEN [DEGREE OF SUBCOOLING AT INDOOR HEAT EXCHANGER] | OPEN [DEGREE OF SUBCOOLING AT INDOOR HEAT EXCHANGER] | OPEN [DEGREE OF SUBCOOLING AT OUTDOOR HEAT EXCHANGER] |
| 2ND EXPANSION DEVICE (22) | OPEN [OPENING DEGREE OF 23] | CLOSED | CLOSED |
| 3RD EXPANSION DEVICE (23) | OPEN [LIQUID OUTLET TEMPERATURE AT GAS-LIQUID SEPARATOR] | OPEN [FULLY OPEN] | OPEN [FULLY OPEN] |
| NOTE | $Gr_0[kg/h] = 1.98(D_{inlet})^2$ | | – |

FIG. 27

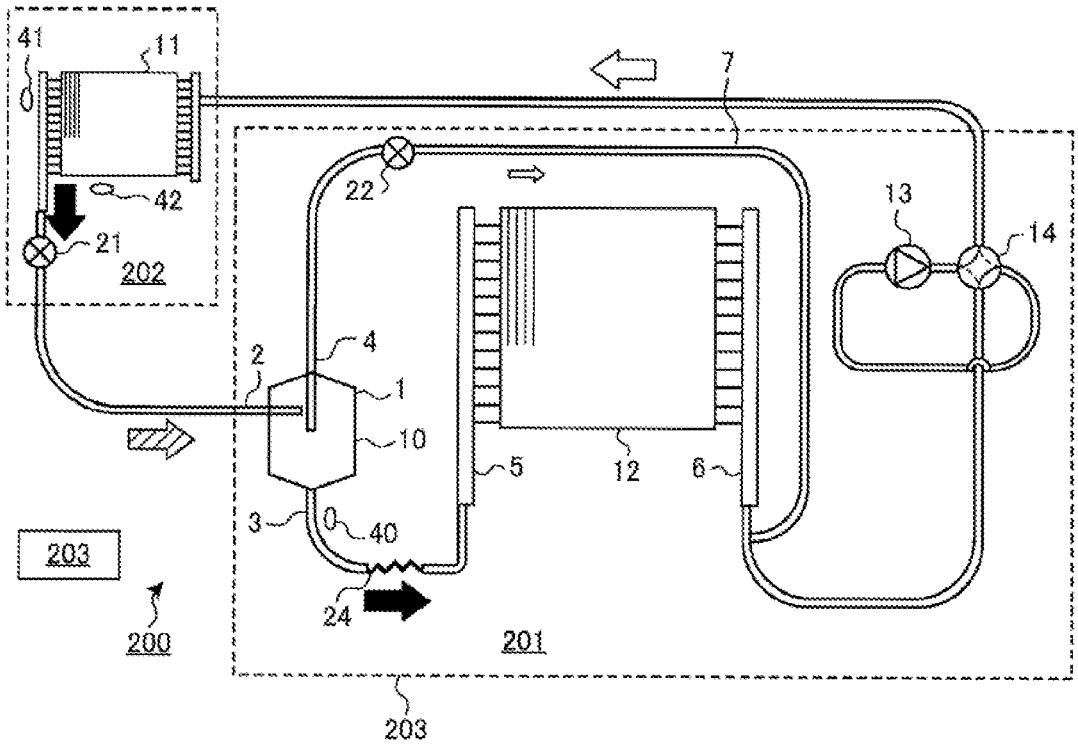

FIG. 28

| EXPANSION DEVICE (NO.) | HEATING ONLY | | COOLING ONLY |
|---|---|---|---|
| | RATED ($Gr_{now} > Gr_0$) | INTERMEDIATE ($Gr_{now} \leq Gr_0$) | |
| 1ST EXPANSION DEVICE (21) | OPEN [DEGREE OF SUBCOOLING AT INDOOR HEAT EXCHANGER] | OPEN [DEGREE OF SUBCOOLING AT INDOOR HEAT EXCHANGER] | OPEN [DEGREE OF SUBCOOLING AT OUTDOOR HEAT EXCHANGER] |
| 2ND EXPANSION DEVICE (22) | OPEN [DEGREE OF SUBCOOLING AT INDOOR HEAT EXCHANGER] | CLOSED | CLOSED |
| 3RD EXPANSION DEVICE (24) | OPEN [FIXED] | OPEN [FIXED] | OPEN [FIXED] |
| NOTE | $Gr_0[kg/h] = 1.98(D_{inlet})^2$ | | ~ |

GAS-LIQUID SEPARATOR SYSTEM FOR REFRIGERATION CYCLE APPARATUS

TECHNICAL FIELD

The present invention relates to a refrigeration cycle apparatus including a gas-liquid separator that reduces the quality of two-phase gas-liquid refrigerant flowing thereinto and then supplies the refrigerant to an evaporator.

BACKGROUND ART

In a hitherto known air-conditioning apparatus, liquid refrigerant condensed by an indoor heat exchanger provided to an indoor unit and serving as a condenser is decompressed by an expansion device provided at the outlet of the condenser and thus falls into a two-phase gas-liquid state in which gas refrigerant and liquid refrigerant both exist. The refrigerant in the two-phase gas-liquid state flows into an outdoor heat exchanger included in an outdoor unit and serving as an evaporator. If the quality of the two-phase gas-liquid refrigerant flowing into the outdoor heat exchanger serving as an evaporator is high, the amount of gas refrigerant that does not contribute to evaporation increases, worsening the heat-exchanging performance of the evaporator.

To reduce the quality of the refrigerant flowing into the evaporator in a heating operation, there is a technique in which a gas-liquid separator that separates refrigerant flowing thereinto in a two-phase gas-liquid state into gas refrigerant and liquid refrigerant is provided in the upstream of the evaporator so that the liquid refrigerant obtained through the separation is made to flow into the evaporator (see Patent Literature 1, for example). According to Patent Literature 1, the gas-liquid separator includes a container, an inflow pipe extending through a side wall of the container, a gas outflow pipe extending vertically through a central part of an upper wall of the container, and a gas outflow pipe extending through a bottom wall of the container. The two-phase gas-liquid refrigerant having flowed into the container swirls in the container. The swirling flow generates a centrifugal force acting on the refrigerant, whereby the refrigerant is separated into gas refrigerant and liquid refrigerant. The liquid refrigerant obtained through the separation accumulates at the bottom of the container and is discharged to the outside of the container through the liquid outflow pipe. The gas refrigerant is discharged to the outside of the container through the gas outflow pipe.

CITATION LIST

Patent Literature

Patent Literature 1: Japanese Unexamined Patent Application Publication No. 2014-211265

SUMMARY OF INVENTION

Technical Problem

If major part of the refrigerant flowing into the container is liquid refrigerant, that is, if incoming refrigerant has a quality of 0.50 or lower, the following problem arises in the gas-liquid separator according to Patent Literature 1. Since the amount of liquid refrigerant included in the incoming refrigerant is large, the amount of liquid refrigerant that accumulates at the bottom of the container becomes large.

Correspondingly, the gas-liquid interface is raised. Eventually, the gas-liquid interface comes close to a gas outlet positioned in the container, and the amount of liquid accidentally flowing into the gas outflow pipe from the gas outlet increases. Such a situation reduces the efficiency of gas-liquid separation. As a solution to such a problem, the distance between the gas-liquid interface and the gas outlet may be increased. In that case, however, another problem of increase in the size of the container arises.

The present invention is to overcome the above problems and provides a refrigeration cycle apparatus that realizes both improvement in the efficiency of gas-liquid separation and size reduction.

Solution to Problem

A refrigeration cycle apparatus according to an embodiment of the present invention includes a main circuit through which refrigerant circulates and in which a compressor, a condenser, a first expansion device, a centrifugal gas-liquid separator that separates refrigerant into gas refrigerant and liquid refrigerant by using centrifugal force, and an evaporator are connected by refrigerant pipes; and a bypass through which the gas refrigerant obtained through the separation by the gas-liquid separator is returned to a suction side of the compressor, wherein the gas-liquid separator includes a cylindrical container, an inflow pipe, a gas outflow pipe, and a liquid outflow pipe, wherein the main circuit includes a second expansion device provided between the liquid outflow pipe of the gas-liquid separator and the evaporator, and wherein the gas refrigerant discharged from the gas outflow pipe of the gas-liquid separator flows into the bypass, and the bypass is provided with a third expansion device.

Advantageous Effects of Invention

In the refrigeration cycle apparatus according to the embodiment of the present invention, the first expansion device, the second expansion device, and the third expansion device are provided on a refrigerant inlet side and a refrigerant outlet side relative to the gas-liquid separator. Therefore, not only the refrigerant pressure in the gas-liquid separator but also the shape of a gas-liquid interface formed in the gas-liquid separator can be controlled. Hence, if the expansion devices are controlled such that the liquid refrigerant accumulated in the gas-liquid separator is not discharged from the gas outlet of the gas-liquid separator, the performance of gas-liquid separation can be improved without changing the size of the container. That is, the performance improvement of the gas-liquid separator and the size reduction of the container are both realized.

BRIEF DESCRIPTION OF DRAWINGS

FIG. 25 is an exemplary graph illustrating changes in the gas-liquid-separation efficiency $\eta$ and in the liquid-surface height h that occur with changes in the opening degrees of expansion devices 21 to 23 in the refrigeration cycle apparatus 200 according to Embodiment 8 of the present invention.

FIG. 26 is an exemplary table summarizing operations of opening and closing the expansion devices 21 to 23 in the refrigeration cycle apparatus 200 according to Embodiment 8 of the present invention.

FIG. 27 is a diagram illustrating a configuration of a refrigeration cycle apparatus 200 according to Embodiment 9 of the present invention.

FIG. 28 is an exemplary table summarizing operations of opening and closing the expansion devices 21 to 23 in the refrigeration cycle apparatus 200 according to Embodiment 9 of the present invention.

DESCRIPTION OF EMBODIMENTS

Figure 1:
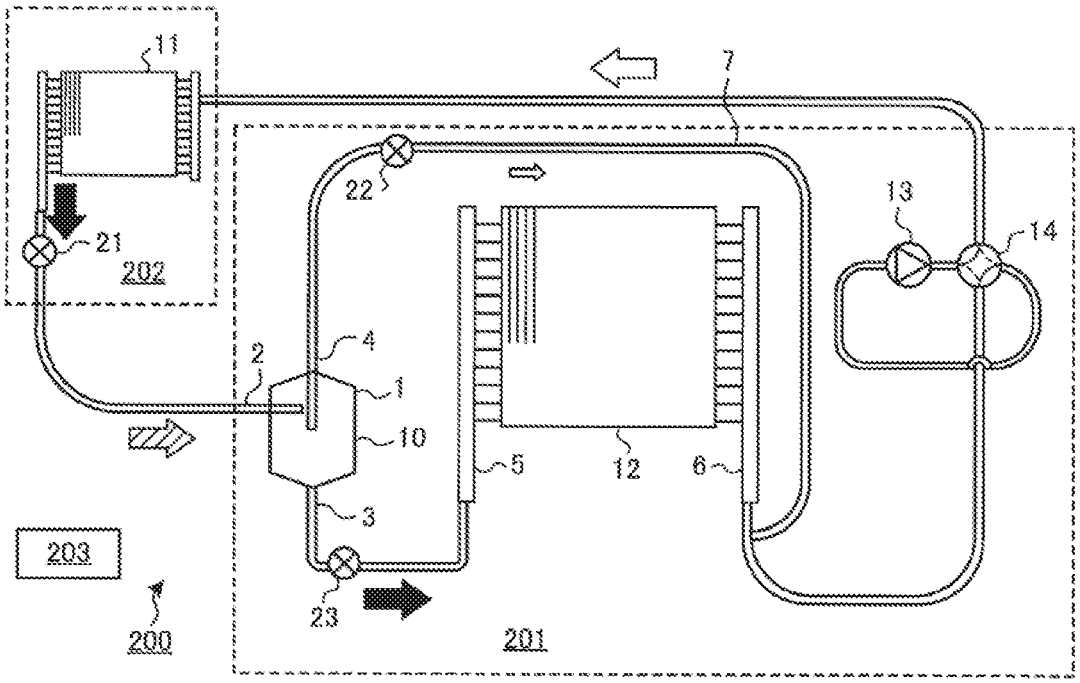
FIG. 1 is a diagram illustrating a configuration of a refrigeration cycle apparatus 200 according to Embodiment 1 of the present invention.

Embodiments of the refrigeration cycle apparatus including the same according to the present invention will now be described. Embodiments illustrated in the drawings are only exemplary and do not limit the present invention. Furthermore, like reference numerals used in the drawings denote like or corresponding elements, which applies throughout this specification. Furthermore, the elements illustrated in the drawings to be referred to below are not necessarily to scale. Furthermore, the levels of pressure and other factors are not defined by particular absolute values thereof but are each defined on the relative basis by the state, operation, or any other factors of a system, an apparatus, or any other devices relevant thereto.

Embodiment 1

FIG. 1 is a diagram illustrating a configuration of a refrigeration cycle apparatus 200 according to Embodiment 1 of the present invention. In FIG. 1, the white arrow represents the flow of gas refrigerant, the black arrow represents the flow of liquid refrigerant, and the hatched arrow represents the flow of two-phase refrigerant. The terms of upstream, downstream, inlet, and outlet to be used in the following description are defined on the basis of the direction represented by the above arrows.

The refrigeration cycle apparatus 200 according to Embodiment 1 forms a main circuit of a refrigerant circuit through which refrigerant circulates and in which a compressor 13, a four-way valve 14, an indoor heat exchanger 11, a second expansion device 22, a gas-liquid separator 10, and an outdoor heat exchanger 12 are connected by refrigerant pipes.

The gas-liquid separator 10 includes a cylindrical container 1. The container 1 is provided with an inflow pipe 2, a liquid outflow pipe 3, and a gas outflow pipe 4. The gas-liquid separator 10 separates two-phase gas-liquid refrigerant flowing thereinto from a first expansion device 21 into liquid refrigerant and gas refrigerant. Details of the gas-liquid separator 10 will be described separately below.

The refrigeration cycle apparatus 200 further includes a bypass 7 through which the gas refrigerant obtained through the separation by the gas-liquid separator 10 is returned to a suction side of the compressor 13. The bypass 7 is provided with the second expansion device 22. An end of the bypass 7 that is on the compressor suction side may be connected either to the pipe provided on the in downstream relative to an outlet header 6, to be described below, of the outdoor heat exchanger 12 as illustrated in FIG. 1, or to the outlet header 6. While the conduit designated with 7 is called bypass 7, the bypass of this document may be considered to include the pipe 4 and the second expansion device 22.

The refrigeration cycle apparatus 200 further includes a third expansion device 23 provided between the gas-liquid separator 10 and the outdoor heat exchanger 12 in the main circuit.

The first expansion device 21, the second expansion device 22, and the third expansion device 23 are each an expansion valve whose opening degree is adjustable. The expansion valve may be an electronic expansion valve in which the opening degree of a restrictor is variably adjustable by using a stepping motor (not illustrated). Hereinafter, the first expansion device 21, the second expansion device 22, and the third expansion device 23 are collectively denoted as the expansion devices 21 to 23 when all of them are mentioned.

The outdoor heat exchanger 12 includes an inlet header 5 and the outlet header 6 arranged at an interval therebetween. The outdoor heat exchanger 12 is a fin-tube heat exchanger including many heat exchanger tubes and fins provided between the headers. Distributors provided at the inlet and the outlet, respectively, of the outdoor heat exchanger 12 are not limited to such headers and may each be a distributor-type impact distributor.

The compressor 13, the second expansion device 22, the gas-liquid separator 10, the third expansion device 23, and the outdoor heat exchanger 12 are included in an outdoor unit 201. The indoor heat exchanger 11 and the first expansion device 21 are included in an indoor unit 202.

The refrigeration cycle apparatus 200 further includes a controller 203 that controls the entirety of the refrigeration cycle apparatus 200. The controller 203 may be configured either as a piece of hardware such as a circuit device that realizes relevant functions, or as a combination of an arithmetic device, such as a microcomputer or a CPU, and software to be executed thereon.

In the refrigeration cycle apparatus 200 configured as above, the outdoor heat exchanger 12 serves as a condenser, and the indoor heat exchanger 11 serves as an evaporator. The refrigeration cycle apparatus 200 is intended for, for example, an air-conditioning apparatus, a water heating apparatus, or any other like device. Embodiment 1 relates to a case where the refrigeration cycle apparatus 200 is used for an air-conditioning apparatus, FIG. 1 illustrates a case where a single outdoor heat exchanger 12 is provided. The present embodiment is not particularly limited to such a case. A plurality of outdoor heat exchangers 12 may be provided, as long as the third expansion device 23 is provided to the refrigerant pipe provided between the gas-liquid separator 10 and the plurality of outdoor heat exchangers 12. If a plurality of outdoor heat exchangers 12 are provided, the end of the bypass 7 that is on the compressor suction side only needs to be connected to the outlet header 6 of at least one of the plurality of outdoor heat exchangers 12 or to the pipe provided in downstream of the outlet header 6.

The number of outdoor units 201 is not limited to one, either. A plurality of outdoor units 201 may be provided. Furthermore, a plurality of indoor heat exchangers 11 may be provided, as long as the first expansion device 21 is provided to the refrigerant pipe provided between the gas-liquid separator 10 and the plurality of indoor heat exchangers 11. A multi-air-conditioning apparatus including a plurality of indoor units 202 is also applicable. Furthermore, the refrigerant pipe connecting the first expansion device 21 and the gas-liquid separator 10 to each other may be provided with a distribution controller that controls the distribution of refrigerant among the plurality of indoor units 202.

The refrigerant circulating through the refrigerant circuit is not particularly limited. However, any of refrigerants having a high gas density, such as R32, R410A, and $CO_2$, is preferable because a great effect of improving the performance of the gas-liquid separator 10 can be obtained.

If olefin-based refrigerant such as R1234yf or R1234ze (E), HFC refrigerant such as R32, or hydrocarbon refrigerant such as propane or isobutane is used, the size of the container is reduced. Correspondingly, the amount of refrigerant to be contained therein is reduced. Olefin-based refrigerant such as R1234yf or R1234ze(E), HFC refrigerant such as R32, and hydrocarbon refrigerant such as propane or isobutane are flammable refrigerant. Therefore, the reduction in the amount of refrigerant to be contained leads to increased safety.

Now, an operation of the refrigeration cycle apparatus 200 according to Embodiment 1 will be described with reference to FIG. 1, taking an exemplary case where the air-conditioning apparatus that allows refrigerant and air to exchange heat therebetween performs a heating operation.

High-temperature high-pressure refrigerant discharged from the compressor 13 flows through the four-way valve 14 and then flows into the indoor heat exchanger 11, where the refrigerant exchanges heat with air passing through the indoor heat exchanger 11, whereby the refrigerant turns into high-pressure liquid refrigerant and is discharged. The high-pressure liquid refrigerant discharged from the indoor heat exchanger 11 is decompressed by the first expansion device 21, thereby turning into two-phase gas-liquid refrigerant. The two-phase gas-liquid refrigerant flows through the inflow pipe 2 into the gas-liquid separator 10.

The two-phase gas-liquid refrigerant having flowed into the gas-liquid separator 10 is separated into liquid refrigerant and gas refrigerant. The liquid refrigerant is discharged from the liquid outflow pipe 3, is decompressed by the third expansion device 23, and flows through the inlet header 5 into the outdoor heat exchanger 12. The refrigerant having flowed into the outdoor heat exchanger 12 evaporates by exchanging heat with air, is merged with refrigerant flowing from the gas outflow pipe 4 in the outlet header 6 or at a position on the downstream side of the outlet header 6, and flows into the compressor 13 again. The gas refrigerant obtained through the separation by the gas-liquid separator 10 is discharged from the gas outflow pipe 4 into the bypass 7, flows through the second expansion device 22, and returns to the suction side of the compressor 13.

Figure 2:
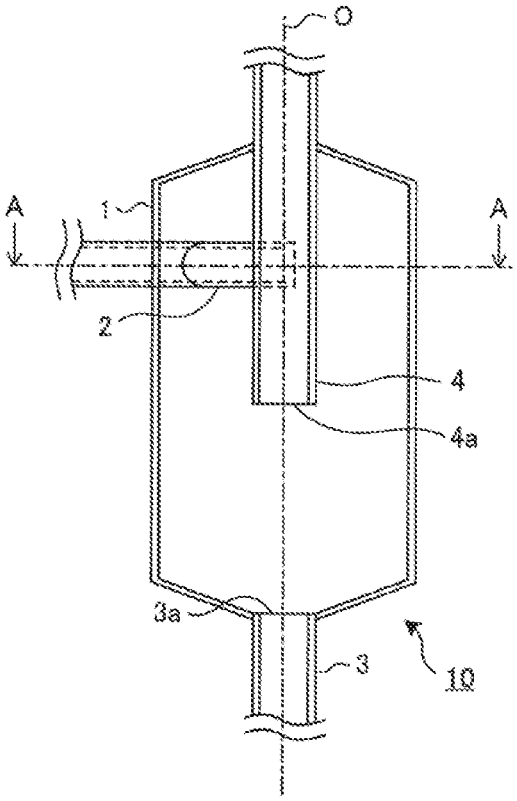
FIG. 2 is a sectional view of a gas-liquid separator 10 included in the refrigeration cycle apparatus 200 according to Embodiment 1 of the present invention.
Figure 3:
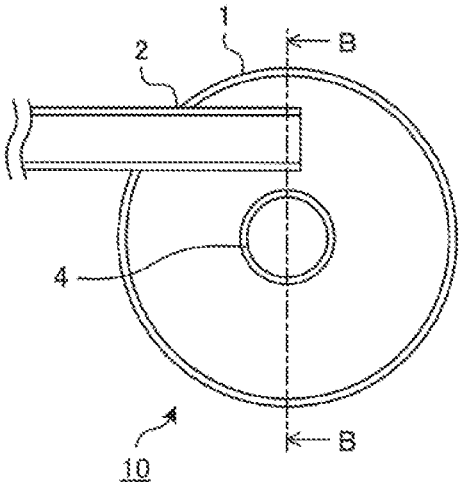
FIG. 3 is a sectional view taken along line A-A illustrated in FIG. 2.
Figure 4:
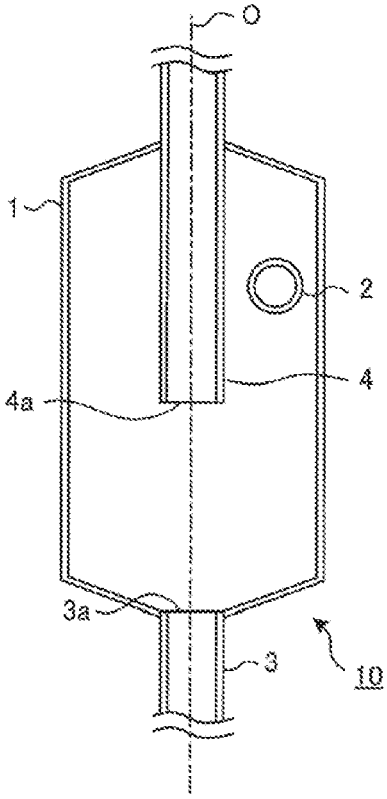
FIG. 4 is a sectional view taken along line B-B illustrated in FIG. 3.
Figure 5:
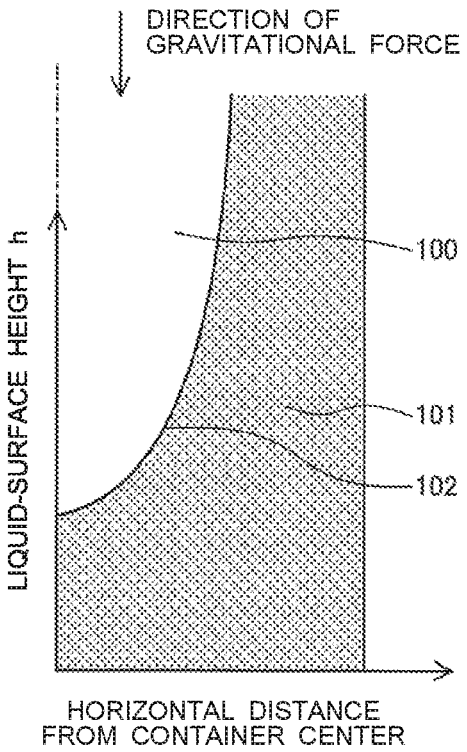
FIG. 5 is a conceptual diagram illustrating the relationship between the horizontal distance from the center of a container and a liquid-surface height h in the gas-liquid separator 10 of the refrigeration cycle apparatus 200 according to Embodiment 1 of the present invention.

FIG. 2 is a sectional view of the gas-liquid separator 10 included in the refrigeration cycle apparatus 200 according to Embodiment 1 of the present invention. FIG. 3 is a sectional view taken along line A-A illustrated in FIG. 2. FIG. 4 is a sectional view taken along line B-B illustrated in FIG. 3. FIG. 5 is a conceptual diagram illustrating the relationship between the horizontal distance from the center of the container and a liquid-surface height h in the gas-liquid separator 10 of the refrigeration cycle apparatus 200 according to Embodiment 1 of the present invention.

The gas-liquid separator 10 is a centrifugal gas-liquid separator and separates liquid and gas contained in gas-liquid mixed refrigerant from each other by generating a swirling flow of the gas-liquid mixed refrigerant in the container 1 and thus causing the liquid contained in the swirling flow to adhere to the inner peripheral surface of the container 1 with a centrifugal force. In the gas-liquid separator 10, the inflow pipe 2 is inserted through an upper part of the side wall of the container 1, with one end thereof being positioned inside the container 1 and the other end thereof being connected to the first expansion device 21. The inflow pipe 2 is shifted from a center line O of the container 1 so that the center line O does not meet the extension of part of the inflow pipe 2 that is positioned inside the container 1. The liquid outflow pipe 3 is connected to the bottom of the container 1, with a liquid outlet 3*a* at one end thereof being positioned in a central part of the bottom wall of the container 1. The gas outflow pipe 4 vertically is inserted through a central part of the upper wall of the container 1, with a gas outlet 4*a* at one end thereof being positioned inside the container 1 and the other end thereof being connected to the bypass 7.

In the gas-liquid separator 10 configured as above, the two-phase gas-liquid refrigerant having flowed into the container 1 swirls in the container 1. The swirling flow generates a centrifugal force acting on the refrigerant, whereby the refrigerant is separated into liquid refrigerant and gas refrigerant. That is, the difference between the centrifugal force acting on liquid refrigerant, which is relatively heavy, and the centrifugal force acting on gas refrigerant, which is relatively light, causes the two-phase gas-liquid refrigerant to be separated into the liquid refrigerant and the gas refrigerant. The liquid refrigerant flows from the liquid outlet 3*a* into the liquid outflow pipe 3 and is discharged to the outside of the container 1. The gas refrigerant flows from the gas outlet 4*a* into the gas outflow pipe 4 and is discharged to the outside of the container 1.

In the container 1, as illustrated in FIG. 5, the liquid refrigerant adhered to the wall surface in the container 1 forms a liquid-main region 101 near the wall surface in the container 1, whereas the gas refrigerant forms a gas-main region 100 near the center line O of the container 1. In this state, a gas-liquid interface 102 at the boundary between the gas-main region 100 and the liquid-main region 101 forms a conical surface having a vertex on the lower side in the direction of gravitational force. The shape of the conical surface such as the solid angle, the height from the bottom of the container, and so forth, or the shape of the gas-liquid interface 102, will further be described.

Figure 6:
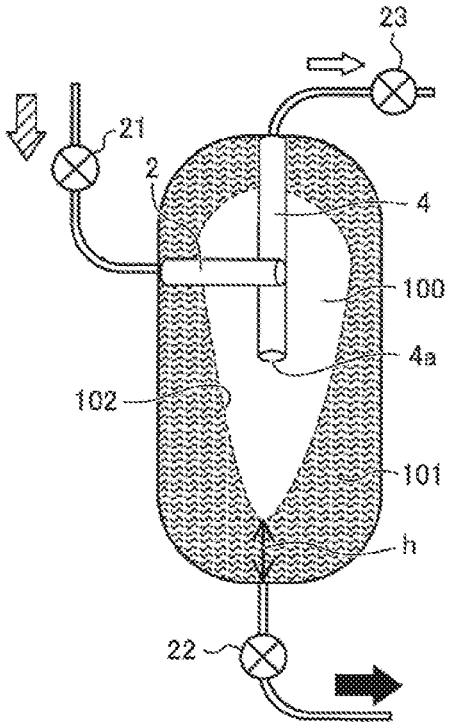
FIG. 6 is a schematic diagram (No. 1) illustrating a state of the inside of the gas-liquid separator 10 included in the refrigeration cycle apparatus 200 according to Embodiment 1 of the present invention.
Figure 7:
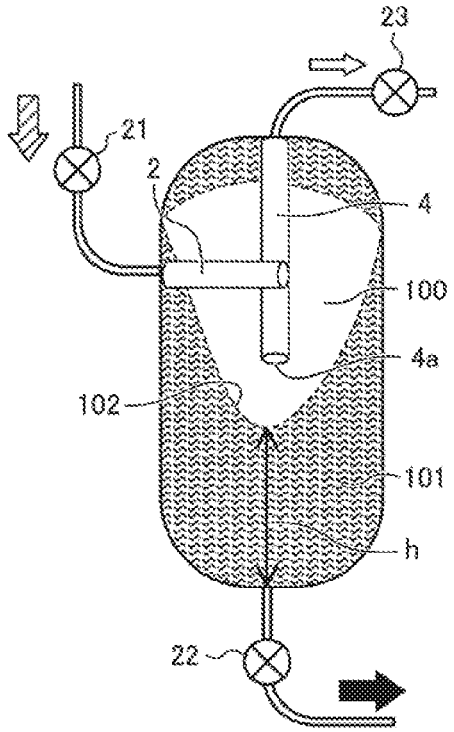
FIG. 7 is a schematic diagram (No. 2) illustrating a state of the inside of the gas-liquid separator 10 included in the refrigeration cycle apparatus 200 according to Embodiment 1 of the present invention.
Figure 8:
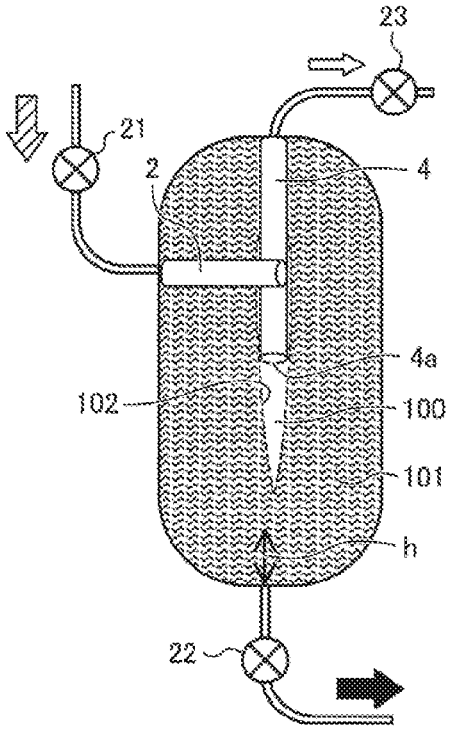
FIG. 8 is a schematic diagram (No, 3) illustrating a state of the inside of the gas-liquid separator 10 included in the refrigeration cycle apparatus 200 according to Embodiment 1 of the present invention.
Figure 9:
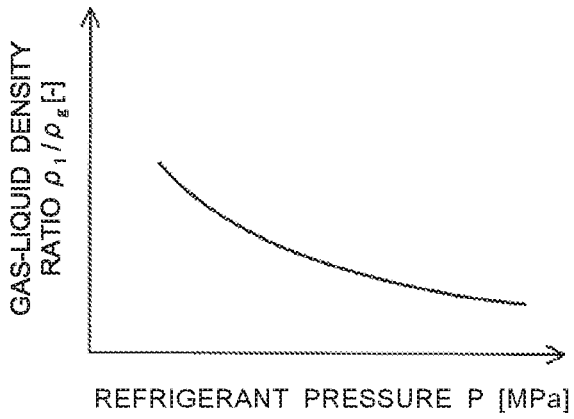
FIG. 9 is a conceptual diagram illustrating the relationship between the refrigerant pressure and the gas-liquid density ratio of two-phase gas-liquid refrigerant.

FIGS. 6 to 8 are schematic diagrams illustrating different states of the inside of the gas-liquid separator 10 included in the refrigeration cycle apparatus 200 according to Embodiment 1 of the present invention. FIG. 9 is a conceptual diagram illustrating the relationship between the refrigerant pressure and the gas-liquid density ratio of the two-phase gas-liquid refrigerant.

In the container 1 of the gas-liquid separator 10, as illustrated in FIGS. 6 to 8, the ratio between the liquid-main region 101 and the gas-main region 100 changes with the inflow velocity, the quality, and a gas-liquid density ratio $\rho_l/\rho_g$ of the two-phase gas-liquid refrigerant flowing into the container 1. Correspondingly, the shape of the gas-liquid interface 102 changes. The gas-liquid density ratio $\rho_l/\rho_g$ refers to a liquid-phase density $\rho_l$ relative to a gas-phase density $\rho_g$.

If the distance between the gas-liquid interface 102 and the gas outlet 4*a* of the gas outflow pipe 4 is short, the liquid refrigerant flows into the gas outlet 4*a* from the liquid-main region 101. Consequently, the performance of gas-liquid separation is reduced. Therefore, the gas outlet 4*a* of the gas outflow pipe 4 and the gas-liquid interface 102 need to be at a satisfactory distance from each other so that accidental flowing of the liquid from the liquid-main region 101 into the gas outflow pipe 4 can be prevented.

In FIG. 6, the distance between the gas outlet 4*a* of the gas outflow pipe 4 and the gas-liquid interface 102 is appropriate. Therefore, accidental flowing of the liquid into the gas outflow pipe 4 is prevented, and the reduction in the gas-liquid separability can be suppressed. In contrast, in FIG. 7, the distance between the gas outlet 4*a* of the gas outflow pipe 4 and the gas-liquid interface 102 is short, and there is a chance of accidental flowing of the liquid. In FIG. 8, there is also a chance of accidental flowing of the liquid because the ratio of the gas-main region 100 is small.

As described above, the shape of the gas-liquid interface 102 depends on the inflow velocity, the quality, and the gas-liquid density ratio of the refrigerant. The inflow velocity and the quality are determined by the operating capacity of the air-conditioning apparatus and indoor-air conditions. In general, as illustrated in FIG. 9, there is a correlation between the refrigerant pressure P and the gas-liquid density ratio $\rho_l/\rho_g$. Therefore, the gas-liquid density ratio inside the container 1 is adjustable by adjusting the refrigerant pressure inside the container 1. Consequently, the shape of the gas-liquid interface 102 can be adjusted. Hence, accidental flowing of the liquid from the liquid-main region 101 into the gas outflow pipe 4 can be prevented by adjusting the refrigerant pressure inside the container 1 and adjusting the shape of the gas-liquid interface 102 such that a satisfactory distance is provided between the gas-liquid interface 102 and the gas outlet 4*a* of the gas outflow pipe 4.

Embodiment 1 is characterized in that the expansion devices 21 to 23 are provided on the refrigerant inlet side and the refrigerant outlet side relative to the gas-liquid separator 10. Since the opening degrees of the expansion devices 21 to 23 are individually controllable, the refrigerant pressure inside the container 1 is changeable arbitrarily, regardless of the difference between the high pressure and the low pressure in the refrigeration cycle, that is, regardless of the capacities of the condenser and the evaporator. Therefore, the shape of the gas-liquid interface 102 can be adjusted. If the refrigerant employed is, for example, R410A, the gas-liquid density ratio is adjustable in a range between twelvefold and sixtyfold. A specific method of controlling the opening degrees of the expansion devices 21 to 23 will be described separately in Embodiment 8.

As described above, the shape of the gas-liquid interface 102 is adjustable by controlling the opening degrees of the expansion devices 21 to 23 individually. Therefore, the opening degrees of the expansion devices 21 to 23 are adjusted such that a satisfactory distance is provided between the gas-liquid interface 102 and the gas outlet 4*a* of the gas outflow pipe 4. Thus, accidental flowing of the liquid from the liquid-main region 101 into the gas outflow pipe 4 is suppressed. Hence, the performance of gas-liquid separation can be improved.

To summarize, in the refrigeration cycle apparatus 200 according to Embodiment 1, since the expansion devices 21 to 23 are provided on the refrigerant inlet side and the refrigerant outlet side of the gas-liquid separator 10, not only the refrigerant pressure but also the gas-liquid density ratio in the gas-liquid separator 10 is adjustable. Therefore, the shape of the gas-liquid interface 102 in the gas-liquid separator 10 can be controlled. Hence, the performance of gas-liquid separation can be improved by controlling the expansion devices 21 to 23 such that the gas-liquid interface 102 has such a shape as to be at a satisfactory distance from the gas outlet 4*a* of the gas outflow pipe 4.

Furthermore, according to Embodiment 1, since the performance of gas-liquid separation can be improved without changing the size of the container 1, the performance improvement of the gas-liquid separator 10 and the size reduction of the container 1 are both realized. This contributes to cost reduction and prevents the occurrence of a problem that the gas-liquid separator 10 of a large size cannot be installed in a housing of a relevant product.

The refrigeration cycle apparatus 200 configured as illustrated in FIG. 1 may be modified as follows.

Figure 10:
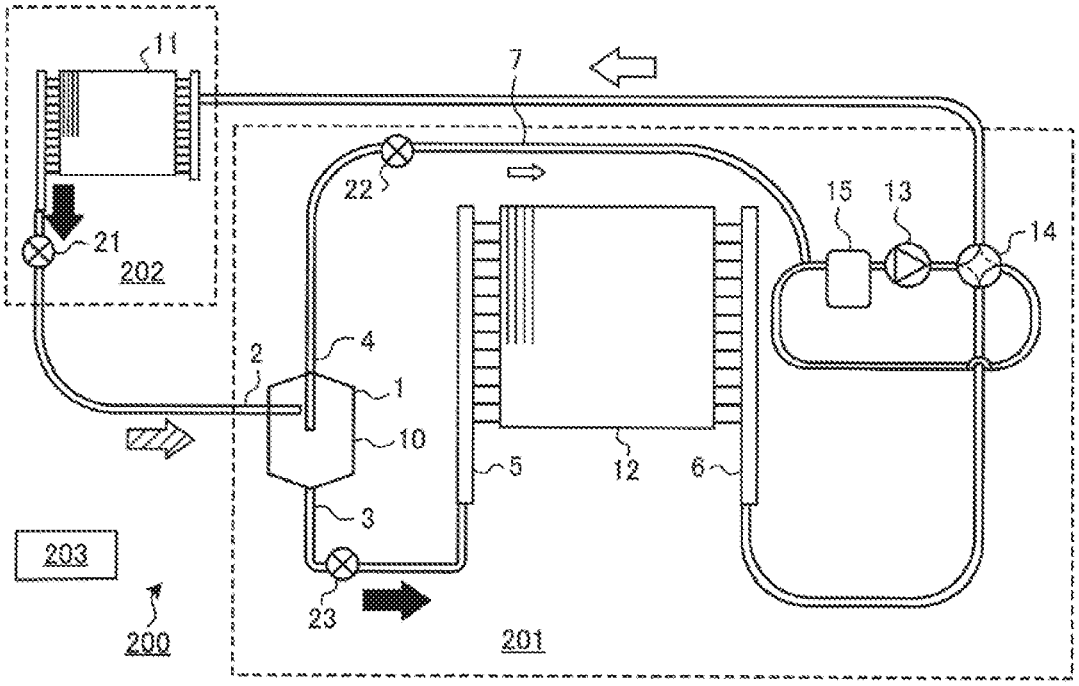
FIG. 10 is a diagram illustrating a modification of the refrigeration cycle apparatus 200 according to Embodiment 1 of the present invention.

FIG. 10 is a diagram illustrating a modification of the refrigeration cycle apparatus 200 according to Embodiment 1 of the present invention.

In the modification of the refrigeration cycle apparatus 200 illustrated in FIG. 10, the end of the bypass 7 that is on the compressor suction side is connected to a position in the upstream relative to a refrigerant tank 15 such as an accumulator, that is, between the refrigerant tank 15 and the four-way valve 14. Such a configuration also produces the advantageous effects described above.

Embodiment 2

Embodiment 2 relates to the height-direction position of insertion of the inflow pipe 2 and the length of insertion of the gas outflow pipe 4 in the gas-liquid separator 10. The gas-liquid separator 10 and the refrigeration cycle apparatus 200 are configured as in Embodiment 1. Now, Embodiment 2 will be described, focusing on differences from Embodiment 1.

Figure 11:
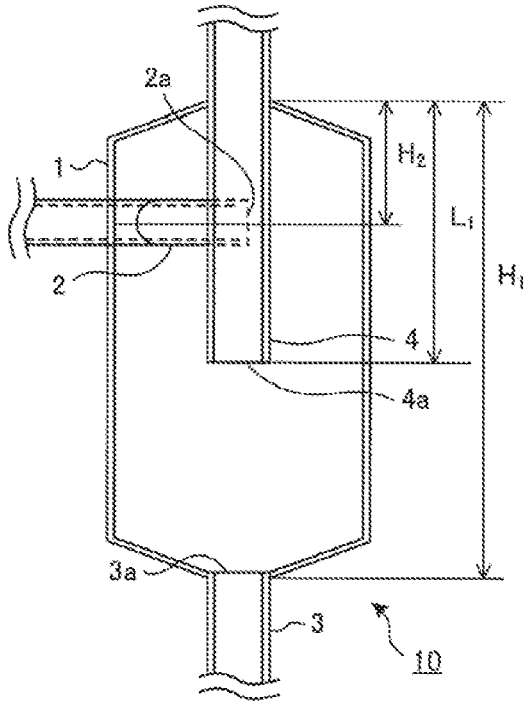
FIG. 11 is a diagram illustrating dimensional definitions of a gas-liquid separator 10 included in a refrigeration cycle apparatus 200 according to Embodiment 2 of the present invention.

FIG. 11 is a diagram illustrating dimensional definitions of a gas-liquid separator 10 included in a refrigeration cycle apparatus 200 according to Embodiment 2 of the present invention.

The gas-liquid separator 10 according to Embodiment 2 is designed such that the inflow pipe 2 and the gas outflow pipe 4 are positioned relative to the container 1 in the following dimensional relationships:

$$0.26H_1 \leq L_1 \leq 0.65H_1 \quad (1), \text{ and}$$

$$0.25H_1 \leq L_1 - H_2 \quad (2)$$

where $L_1$: length of insertion of gas outflow pipe 4 from upper end of container 1 (hereinafter referred to as gas-outflow-pipe insertion length)

$H_1$: container height $H_2$: vertical distance from upper end of container 1 to height-direction position of insertion of inflow pipe 2 (hereinafter referred to as inflow-pipe insertion height position)

That is, the gas-outflow-pipe insertion length $L_1$ relative to the container height $H_1$ is set to $0.26H_1$ or greater and $0.65H_1$ or smaller, and "$L_1$-$H_2$" expressing the height-direction distance from the height-direction position of insertion of the inflow pipe 2 to the gas outlet 4*a* of the gas outflow pipe 4 is set to greater than $0.25H_1$. Thus, high efficiency of gas-liquid separation can be obtained. The reasons for such a design will now be described.

Figure 12:
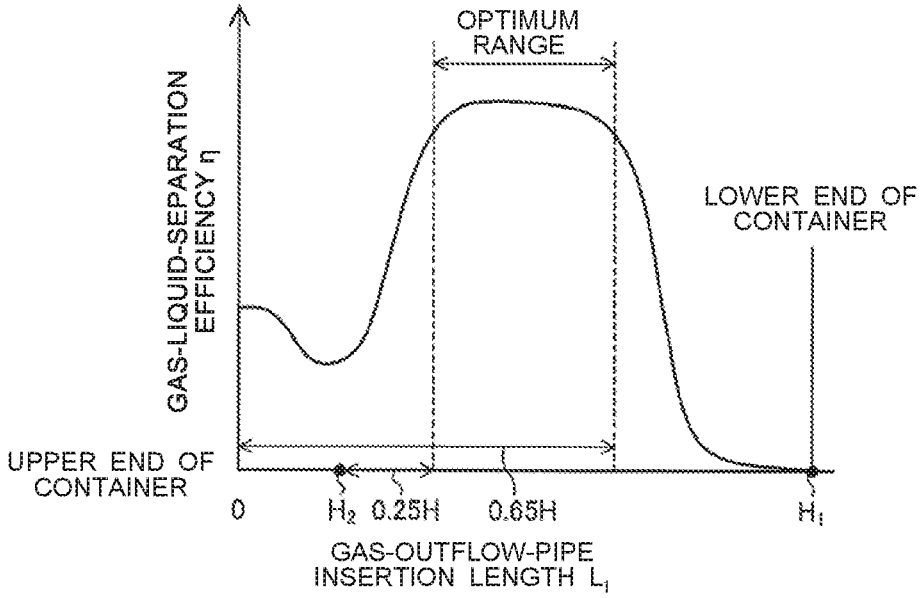
FIG. 12 is an exemplary graph illustrating the relationship between a gas-outflow-pipe insertion length $L_1$ and a gas-liquid-separation efficiency $\eta$, illustrating the effect of improvement in the performance of gas-liquid separation by the gas-liquid separator 10 included in the refrigeration cycle apparatus 200 according to Embodiment 2 of the present invention.

FIG. 12 is an exemplary graph illustrating the relationship between the gas-outflow-pipe insertion length $L_1$ and the gas-liquid-separation efficiency η, illustrating the effect of improvement in the performance of gas-liquid separation by the gas-liquid separator 10 included in the refrigeration cycle apparatus 200 according to Embodiment 2 of the present invention. FIG. 12 illustrates changes in the gas-liquid-separation efficiency η that occur when the gas-outflow-pipe insertion length $L_1$ is changed, with the inflow-pipe insertion height position $H_2$ being fixed to $0.2H_1$.

As illustrated in FIG. 12, the gas-liquid-separation efficiency η changes with the gas-outflow-pipe insertion length $L_1$. As the gas-outflow-pipe insertion length $L_1$ is increased from a point of $L_1=0$, that is, as the gas outflow pipe 4 is made longer downward from the upper end of the container, the gas outlet 4*a* comes closer to an inlet 2*a* (see FIG. 11) of the inflow pipe 2 of the inflow pipe 2. In such a situation, the amount of liquid component in the refrigerant that directly flows into the gas outflow pipe 4 after flowing into the container from the inlet 2*a* of the inflow pipe 2 increases. Therefore, the gas-liquid-separation efficiency is reduced as illustrated in FIG. 12.

As the gas-outflow-pipe insertion length $L_1$ is increased further, the gas-liquid-separation efficiency becomes lowest near a point of $L_1=H_2$. As the gas-outflow-pipe insertion length $L_1$ is increased much further, the gas-liquid-separation efficiency sharply increases. The increasing gas-liquid-separation efficiency is substantially saturated at a point of $L_1>H_2+0.25H_1$, and then sharply drops when $L_1$ exceeds $0.65H_1$. This reduction in the gas-liquid-separation efficiency occurs because the gas outlet 4*a* of the gas outflow pipe 4 comes close to the gas-liquid interface 102 of the liquid-main region 101 at the bottom of the container 1, allowing the liquid to accidentally flow into the gas outflow pipe 4.

Considering the above changes in the gas-liquid-separation efficiency η that depend on the gas-outflow-pipe insertion length $L_1$, it is understood that high gas-liquid-separation efficiency can be obtained if "$L_1-H_2$" expressing the height-direction distance from the height-direction position of insertion of the inflow pipe 2 to the gas outlet 4*a* of the gas outflow pipe 4 is set to greater than $0.25H_1$. Furthermore, if the gas-outflow-pipe insertion length $L_1$ is set to $L_1 \leq 0.65H_1$, high gas-liquid-separation efficiency η can be obtained.

FIG. 12 illustrates a case of $H_2=0.2H_1$. According to an experiment conducted by the inventors, the following has been found. In a case of $H_2=0$, that is, if the inflow-pipe insertion height position $H_2$ is set to the upper end of the container 1, high gas-liquid-separation efficiency is obtained in a range of $0.26H_1 \leq L_1 \leq 0.65H_1$. It has also been found that such a tendency is seen in a case of a long and narrow gas-liquid separator 10 with an aspect ratio between inside diameter $D_{bottle}$ of the container 1 and the container height $H_1$ of, for example, 3 to 5.

As described above, if the positions of the inflow pipe 2 and the gas outflow pipe 4 relative to the container 1 are designed such that Expressions (1) and (2) above are satisfied, high gas-liquid-separation efficiency can be obtained.

To summarize, according to Embodiment 2, the advantageous effects obtained in Embodiment 1 can also be obtained. Furthermore, with a design satisfying "$0.25H_1<L_1-H_2$", that is, if "$L_1-H_2$" expressing the height-direction distance from the height-direction position $H_2$ of insertion of the inflow pipe 2 to the gas outlet 4*a* of the gas outflow pipe 4 is set to greater than $0.25H_1$, the following advantageous effects are obtained. The liquid refrigerant flowing from the inflow pipe 2 into the container 1 does not directly flow into the gas outflow pipe 4 and can travel a required vertical entrance distance before reaching the liquid-main region 101 near the wall surface under the centrifugal force. Consequently, as illustrated in FIG. 12, the gas-liquid-separation efficiency is improved.

Furthermore, if the gas-outflow-pipe insertion length $L_1$ is set to $0.26H_1$ or greater, the swirling flow generated in the container 1 is prevented from striking upon the upper end of the container 1 and further bouncing therefrom to flow into the gas outflow pipe 4. Therefore, the amount of liquid refrigerant accidentally flowing into the gas outlet 4*a* of the gas outflow pipe 4 is reduced. Consequently, the performance of gas-liquid separation is improved.

Furthermore, if the insertion length $L_1$ of the gas outflow pipe 4 is set to $0.65H_1$ or smaller, a distance of $0.35H_1$ or greater is provided between the gas outlet 4*a* of the gas outflow pipe 4 and the bottom surface of the container. That is, a satisfactory distance is provided between the gas outlet 4*a* of the gas outflow pipe 4 and the gas-liquid interface 102. Hence, suction of refrigerant from the liquid-main region 101 into the gas outflow pipe 4 can be prevented. Consequently, the performance of gas-liquid separation is improved.

Embodiment 3

Embodiment 3 relates to the dimensions of the inflow pipe 2 of the gas-liquid separator 10. The gas-liquid separator 10 and the refrigeration cycle apparatus 200 are configured as in Embodiment 1. Now, Embodiment 3 will be described, focusing on differences from Embodiment 1.

Figure 13:
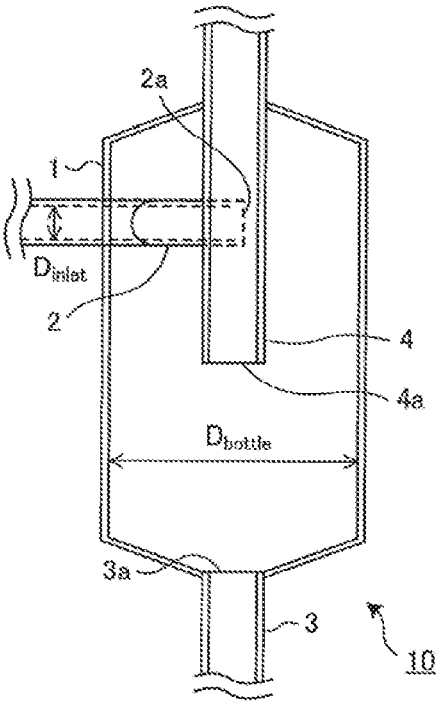
FIG. 13 is a diagram illustrating dimensional definitions of a gas-liquid separator 10 included in a refrigeration cycle apparatus 200 according to Embodiment 3 of the present invention.

FIG. 13 is a diagram illustrating dimensional definitions of a gas-liquid separator 10 included in a refrigeration cycle apparatus 200 according to Embodiment 3 of the present invention.

The gas-liquid separator 10 according to Embodiment 3 is designed with the following dimensional relationships:

$$0<D_{inlet}<0.71Gr^{0.5} \quad (3), \text{ and}$$

$$D_{inlet}<D_{bottle}/2 \quad (4)$$

where $D_{bottle}$: inside diameter [mm] of container 1

$D_{inlet}$: in-pipe equivalent diameter [mm] of inflow pipe 2

Gr: refrigerant mass flow rate [kg/h] in rated heating operation

The in-pipe equivalent diameter is expressed as follows, using flow-path cross-sectional area Af and cross-sectional length L:

$$D_{inlet}=4Af/L$$

Figure 14:
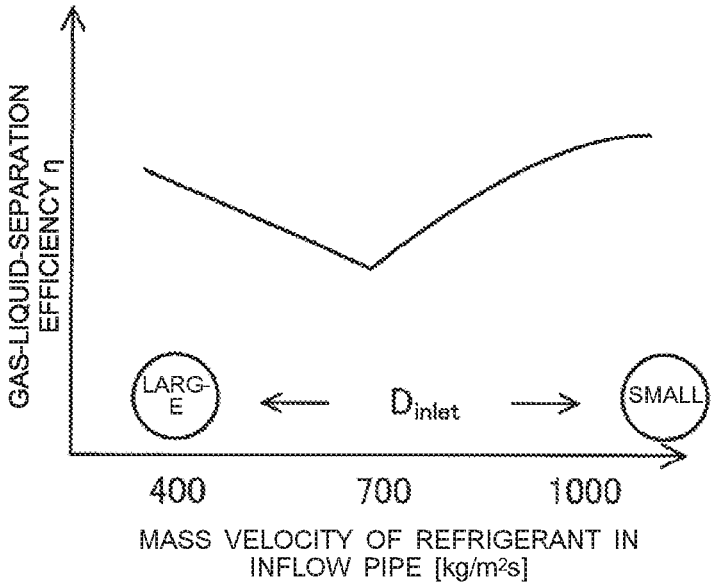
FIG. 14 is an exemplary graph illustrating the relationship between the inlet mass velocity of refrigerant and the gas-liquid-separation efficiency $\eta$, illustrating the effect of improvement in the performance of gas-liquid separation by the gas-liquid separator 10 included in the refrigeration cycle apparatus 200 according to Embodiment 3 of the present invention.

FIG. 14 is an exemplary graph illustrating the relationship between the inlet mass velocity of the refrigerant and the gas-liquid-separation efficiency η, illustrating the effect of improvement in the performance of gas-liquid separation by the gas-liquid separator 10 included in the refrigeration cycle apparatus 200 according to Embodiment 3 of the present invention.

As illustrated in FIG. 14, the gas-liquid-separation efficiency η becomes lowest when the inlet mass velocity of the refrigerant flowing in the inflow pipe 2, that is, the inlet mass velocity of the refrigerant flowing from the inflow pipe 2 into the container, is 700[kg/m$^2$·s] Furthermore, the gas-liquid-separation efficiency η increases as the inlet mass velocity of the refrigerant deviates from 700 [kg/m$^2$·s]. Regarding the gas-liquid separator 10, it has been found from a simulation and so forth that the inlet mass velocity of the refrigerant can be made greater than 700 [kg/m$^2$·s] by making the in-pipe equivalent diameter $D_{inlet}$ of the inflow pipe 2 smaller than "$0.71Gr^{0.5}$". Therefore, $D_{inlet}$ is set such that Expression (3) is satisfied. Furthermore, considering the configuration of relevant devices, it is preferable that $D_{inlet}$ be designed such that Expression (4) is satisfied even if $D_{inlet}$ is maximum, in view of the size of the container 1.

As $D_{inlet}$ is made smaller, the effect of improving the performance of gas-liquid separation with the centrifugal force acting on the refrigerant flowing from the inflow pipe 2 into the container 1 becomes greater than the reduction in the performance of gas-liquid separation under the gravitational force acting on the refrigerant that has struck upon the wall surface of the container. Hence, the performance of gas-liquid separation is improved. Note that the lower limit of $D_{inlet}$ needs to be greater than 0, because the inflow pipe 2 forms a flow path of the refrigeration cycle.

To summarize, according to Embodiment 3, the advantageous effects obtained in Embodiment 1 can also be obtained. Furthermore, since $D_{inlet}$ is set such that Expressions (3) and (4) are satisfied, the performance of gas-liquid separation is further improved.

An experiment conducted by the inventors has demonstrated that an effect of improving the pressure capacity of the gas-liquid separator 10 can be obtained without increasing the size of the container but by reducing the in-pipe equivalent diameter $D_{inlet}$ of the inflow pipe 2. In Embodiment 3, the in-pipe equivalent diameter $D_{inlet}$ of the inflow pipe 2 designed to satisfy Expression (3) produces an effect of improving the pressure capacity of the gas-liquid separator 10. Therefore, the gas-liquid separator 10 can be provided on the high-pressure side of the refrigeration cycle. Accordingly, a refrigerant circuit illustrated in FIG. 15 can be obtained.

Figure 15:
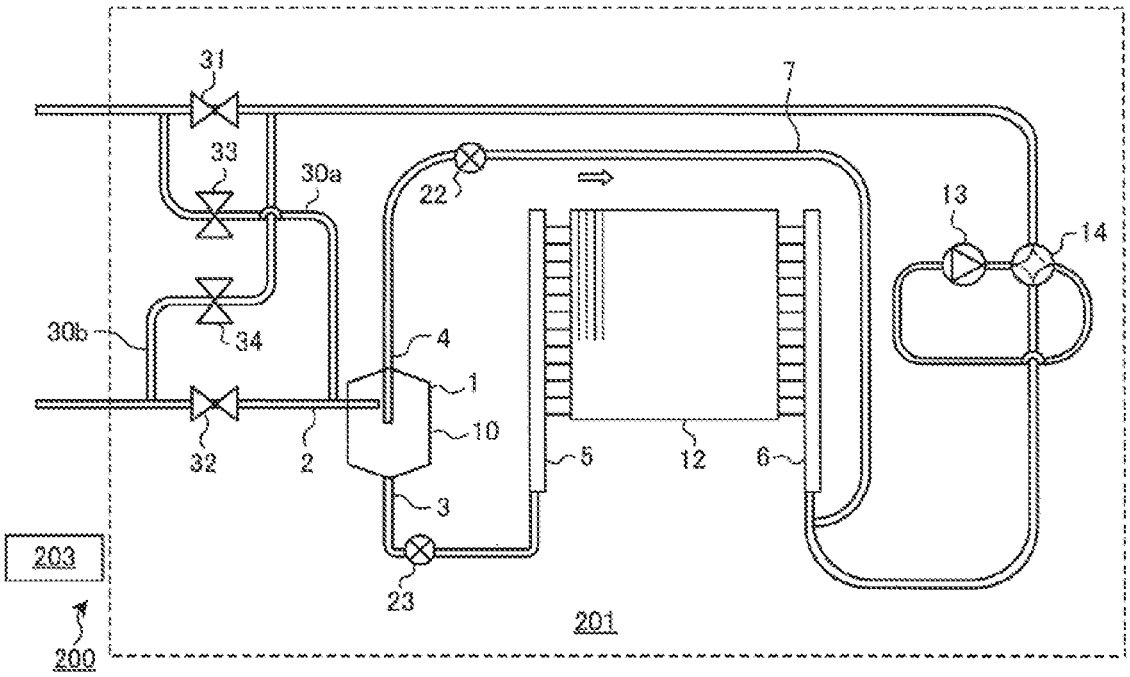
FIG. 15 is a diagram illustrating a refrigerant-pipe configuration of an outdoor unit 201 included in the refrigeration cycle apparatus 200 according to Embodiment 3 of the present invention.

FIG. 15 is a diagram illustrating a refrigerant-pipe configuration of an outdoor unit 201 included in the refrigeration cycle apparatus 200 according to Embodiment 3 of the present invention.

The refrigeration cycle apparatus 200 illustrated in FIG. 15 includes a first switching valve 31, a second switching valve 32, a third switching valve 33, and a fourth switching valve 34, in addition to the elements included in the refrigeration cycle apparatus 200 according to Embodiment 1 illustrated in FIG. 1. The first switching valve 31 is provided to a pipe that connects the compressor 13 and the indoor heat exchanger 11 to each other. The second switching valve 32 is provided to a pipe that connects the first expansion device 21 and the gas-liquid separator 10 to each other. The third switching valve 33 is provided to a pipe 30*a* that connects a downstream part relative to the first switching valve 31 and a downstream part relative to the second switching valve 32 to each other. The fourth switching valve 34 is provided to a pipe 30*b* that connects a part in upstream relative to the first switching valve 31 and a part in upstream relative to the second switching valve 32 to each other.

In the heating operation, the first switching valve 31 and the second switching valve 32 are open, whereas the third switching valve 33 and the fourth switching valve 34 are closed. Thus, a flow of the refrigerant in the heating operation that is the same as in Embodiment 1 is formed. In the cooling operation, the first switching valve 31 and the second switching valve 32 are closed, whereas the third switching valve 33 and the fourth switching valve 34 are open.

In the cooling operation, the four-way valve 14 is switched to form paths illustrated by dotted lines in FIG. 15, whereby the high-temperature high-pressure refrigerant discharged from the compressor 13 and flowed through the four-way valve 14 exchanges heat with air passing through the outdoor heat exchanger 12 and thus turns into high-pressure liquid refrigerant, and is discharged from the outdoor heat exchanger 12. The high-pressure liquid refrigerant discharged from the outdoor heat exchanger 12 is decompressed by the third expansion device 23 and thus turns into two-phase gas-liquid refrigerant, and flows into the gas-liquid separator 10. The refrigerant discharged from the gas-liquid separator 10 is decompressed by the first expansion device 21, and flows into the indoor heat exchanger 11. The refrigerant having flowed into the indoor heat exchanger 11 exchanges heat with air and thus evaporates, and flows into the compressor 13 again.

As described above, the gas-liquid separator 10 is highly resistant to pressure. Therefore, the gas-liquid separator 10 can be provided in downstream of the refrigerant path in the cooling operation relative to an outdoor heat exchanger 12 that generates an in-pipe pressure of, for example, about 3 MPa or higher at maximum in the cooling operation. Hence, for example, a circuit for bypassing the outdoor heat exchanger and a receiver tank for storing liquid refrigerant that are required to perform a cooling-heating mixed operation by using a plurality of indoor units 202 can be provided with no additional pipes.

If the gas-liquid separator 10 is not highly resistant to pressure but includes a circuit for the cooling-heating mixed operation, the circuit needs to be configured as follows. A circuit for bypassing the outdoor heat exchanger that connects "a circuit between the four-way valve 14 and the outlet header 6" and "a circuit between the inlet header 5 and the third expansion device 23" to each other needs to be added. With such additional pipes, the allowance for space is reduced. Moreover, in terms of control operation, it is necessary to control the pressure inside the gas-liquid separator 10 to be reduced by controlling the third expansion device 23, with the second expansion device 22 being fully closed. Actually, since the gas-liquid separator 10 is highly resistant to pressure, the above consideration is not necessary.

Embodiment 4

Embodiment 4 relates to the shape of the container 1 of the gas-liquid separator 10. The refrigeration cycle apparatus 200 is configured as in Embodiment 1. Now, Embodiment 4 will be described, focusing on differences from Embodiment 1.

Figure 16:
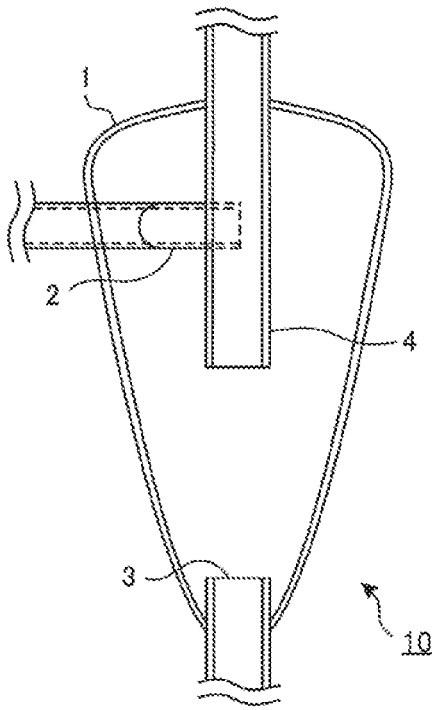
FIG. 16 is a sectional view of a gas-liquid separator 10 included in a refrigeration cycle apparatus 200 according to Embodiment 4 of the present invention.

FIG. 16 is a sectional view of a gas-liquid separator 10 included in a refrigeration cycle apparatus 200 according to Embodiment 4 of the present invention.

The container 1 of the gas-liquid separator 10 according to Embodiment 1 has a circular cylindrical shape. The gas-liquid separator 10 according to Embodiment 4 is characterized in that the container 1 has a conical cylindrical shape projecting toward the lower side in the direction of gravitational force.

To summarize, according to Embodiment 4, the advantageous effects obtained in Embodiment 1 can also be obtained. Furthermore, since the container 1 of the gas-liquid separator 10 has a conical shape projecting toward the lower side in the direction of gravitational force, the following advantageous effect is obtained. The container 1 has a shape conforming to the gas-liquid interface 102 to be formed inside the container 1. Therefore, while the effect of gas-liquid separation with the swirling flow that is obtained in Embodiment 1 employing the cylindrical container 1 is maintained, the volume of the container 1 can be reduced. Hence, the performance improvement and the size reduction of the gas-liquid separator 10 are both realized.

Embodiment 5

Embodiment 5 relates to the shape of the inflow pipe 2 of the gas-liquid separator 10. The refrigeration cycle apparatus 200 is configured as in Embodiment 1. Now, Embodiment 5 will be described, focusing on differences from Embodiment 1.

Figure 17:
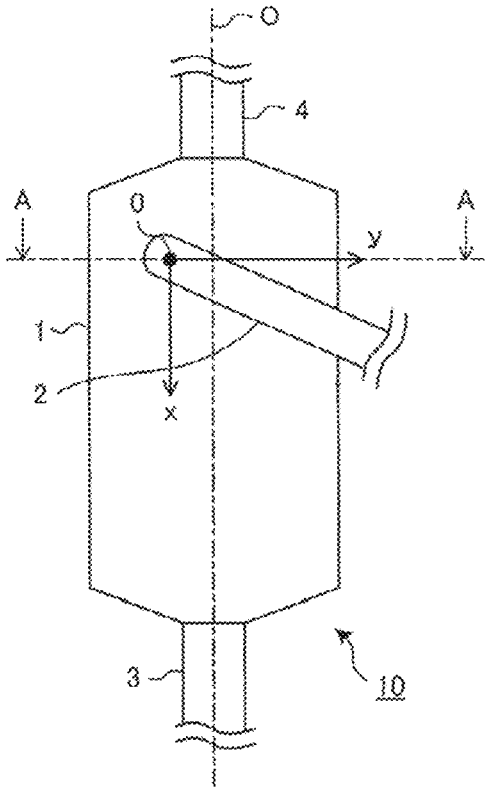
FIG. 17 is a side view of a gas-liquid separator 10 included in a refrigeration cycle apparatus 200 according to Embodiment 5 of the present invention.
Figure 18:
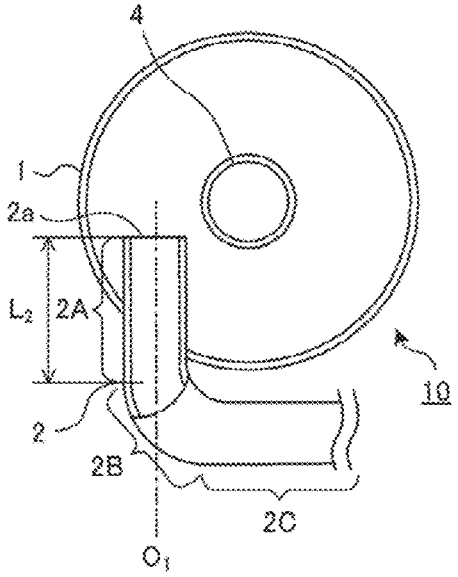
FIG. 18 is a sectional view taken along line A-A illustrated in FIG. 17.

FIG. 17 is a side view of a gas-liquid separator 10 included in a refrigeration cycle apparatus 200 according to Embodiment 5 of the present invention. FIG. 18 is a sectional view taken along line A-A illustrated in FIG. 17.

In the gas-liquid separator 10 according to Embodiment 5, as illustrated in FIG. 18, the inflow pipe 2 is bent at a position outside the container 1 and includes an insertion portion 2A one end of which is positioned inside the container 1, a bent portion 2B extending from the other end of the insertion portion 2A, and an inflow portion 2C extending from the tip of the bent portion.

The insertion portion 2A is inserted through an upper part of the side wall of the container 1, with one end thereof being positioned inside the container 1 and the other end thereof being positioned outside the container 1. The insertion portion 2A is shifted from the center line O of the container 1 so that the center line O does not meet the extension of the insertion portion 2A.

A length $L_2$ of the insertion portion 2A, in other words, a bent position $L_2$ relative to the inlet 2*a*, is designed as follows:

$$0<L_2<15D_{inlet} \tag{5}$$

If $L_2 \geq 15D_{inlet}$, the entrance area provided for the liquid-phase part gathered on the outer peripheral side in the bent portion 2B before flowing into the container 1 becomes long. In such a case, the flow in the insertion portion 2A develops into a less-gathered flow. Consequently, the advantageous effect is reduced. Hence, $L_2$ is set to smaller than $15D_{inlet}$. Furthermore, to generate a gathered flow of liquid by using a bend, $L_2$ is set to greater than 0.

The inflow portion 2C is provided as follows. In an installed state in which the container 1 of the gas-liquid separator 10 is vertically oriented, an orthogonal coordinate system is defined in a plane that is vertical to a center axis $O_1$ of the insertion portion 2A, with the origin being the point of intersection of the plane and the center axis $O_1$. In the coordinate system in which the x axis and they axis are defined as described below, the inflow portion 2C is positioned in a first quadrant that is defined on the positive side of the x axis and on the positive side of the y axis, or in which x>0 and y>0. The x axis is a vertical line extending downward in the direction of gravitational force from the origin 0 defined on the center axis $O_1$ of the insertion portion 2A. The x axis is positive toward the lower side in the direction of gravitational force. The y axis extends on the left and right sides relative to a plane containing the center axis $O_1$ and the x axis. The y axis is positive toward the side of the origin 0 on which the center line O of the container 1 is positioned.

Embodiment 5 is characterized in the inflow pipe 2 designed and positioned as above.

To summarize, according to Embodiment 5, the advantageous effects obtained in Embodiment 1 can also be obtained. Furthermore, since the inflow pipe 2 of the gas-liquid separator 10 includes the bent portion 2B in a middle part thereof, centrifugal force acts on the two-phase gas-liquid refrigerant flowing in the inflow pipe 2. Specifically, different centrifugal forces act on the gas-phase part and the liquid-phase part having different densities. The difference causes the liquid refrigerant to flow on the outer peripheral side in the bent portion 2B and the gas refrigerant to flow on the inner peripheral side in the bent portion 2B. That is, in the bent portion 2B, the liquid refrigerant gathers on the outer peripheral side of the bent portion 2B, and the gas refrigerant gathers on the inner peripheral side of the bent portion 2B. Furthermore, the liquid refrigerant flows into the container 1 while being kept gathered as in the bent portion 2B. Thus, before the refrigerant flows into the container 1, the refrigerant is separated in the inflow pipe 2 into liquid refrigerant and gas refrigerant. Therefore, the performance of gas-liquid separation is improved without changing the size of the container 1. Hence, the performance improvement and the size reduction of the gas-liquid separator 10 are both realized.

If the length of the insertion portion 2A satisfies Expression (5), the entrance distance for the refrigerant flowing from the downstream end of the bent portion 2B to the inlet 2*a* becomes short. Therefore, the effect of keeping the liquid refrigerant gathered as in the bent portion 2B when flowing into the container 1 can be produced more assuredly.

If the inflow portion 2C is on the positive side of the x axis or in the first quadrant, an upward flow of refrigerant is generated in the inflow portion 2C. With the inertia of that flow, the refrigerant discharged from the inflow portion 2C flows upward in the container 1. Therefore, compared with a case where the inflow portion 2C is on the positive side of the y axis, the time over which the centrifugal force acts can be made longer, and the performance of gas-liquid separation can be improved further. If the inflow portion 2C is provided at a position where $x>0$ and $y<0$, the liquid-phase part gathered on the outer peripheral side at the bend of the bent portion 2B adheres to the outer wall of the gas outflow pipe 4 in the container 1. Then, the liquid-phase part runs down the outer wall of the gas outflow pipe 4 and flows into the gas outlet 4*a*. Such a situation cannot satisfactorily produce the above effect.

In Embodiment 5, the bent portion 2B of the inflow pipe 2 has an L shape that is bent by 90 degrees. The angle of bend is not limited to the angle and may be changed arbitrarily.

Embodiment 6

Embodiment 6 relates to the liquid outflow pipe 3 of the gas-liquid separator 10. The refrigeration cycle apparatus 200 is configured as in Embodiment 1. Now, Embodiment 6 will be described, focusing on differences from Embodiment 1.

Figure 19:
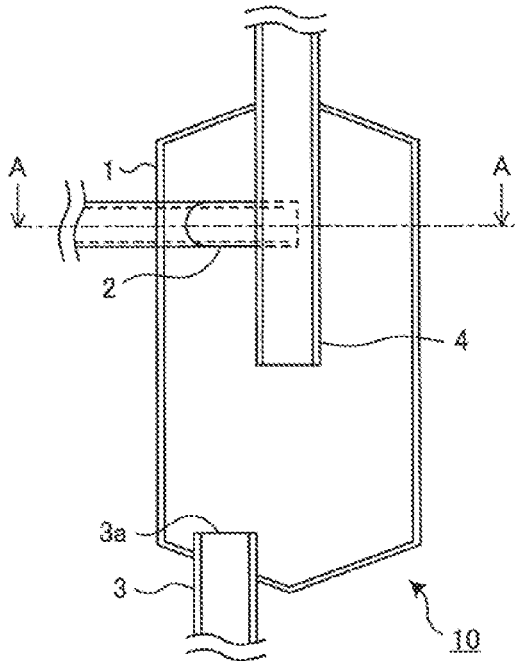
FIG. 19 is a sectional view of a gas-liquid separator 10 included in a refrigeration cycle apparatus 200 according to Embodiment 6 of the present invention.
Figure 20:
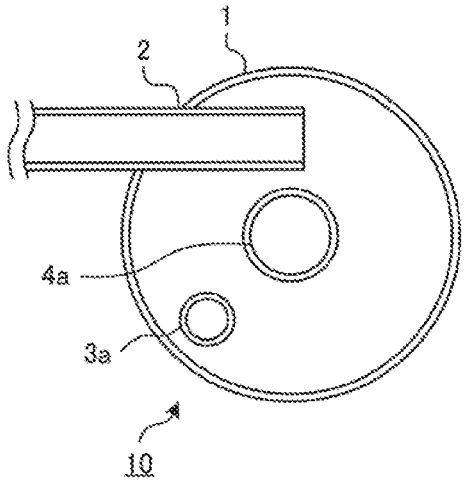
FIG. 20 is a sectional view taken along line A-A illustrated in FIG. 19.

FIG. 19 is a sectional view of a gas-liquid separator 10 included in a refrigeration cycle apparatus 200 according to Embodiment 6 of the present invention. FIG. 20 is a sectional view taken along line A-A illustrated in FIG. 19.

In the gas-liquid separator 10 according to Embodiment 6, as illustrated in FIG. 20, the liquid outlet 3*a* of the liquid outflow pipe 3 is at a position not overlapping the gas outlet 4*a* of the gas outflow pipe 4 in plan view.

To summarize, according to Embodiment 6, the advantageous effects obtained in Embodiment 1 can also be obtained. Furthermore, since the liquid outlet 3*a* of the liquid outflow pipe 3 is at a position not overlapping the gas outlet 4*a* of the gas outflow pipe 4 in plan view, the following advantageous effect is obtained. Even if any gas refrigerant that has accidentally flowed into the liquid outflow pipe 3 but has come out of the liquid outflow pipe 3 with its buoyancy flows upward in the container 1 and pushes the liquid refrigerant that is in the upward path, the liquid refrigerant pushed by the gas refrigerant going upward can be prevented from flowing into the gas outlet 4*a* of the gas outflow pipe 4. Hence, the performance of gas-liquid separation is improved.

In Embodiment 6, the container 1 is provided with a single liquid outflow pipe 3. Alternatively, the container 1 may be provided with two or more liquid outflow pipes 3. That is, two or more liquid outlets 3*a* may be provided. The second and subsequent ones of the liquid outflow pipes 3 may be connected to the inlet header 5 at the lower ends thereof. Such a configuration also produces the above advantageous effects if the liquid outlets 3*a* are provided at positions not overlapping the gas outlet 4*a* of the gas outflow pipe 4 in plan view.

The gas-liquid separator 10 according to Embodiment 6 illustrated in FIG. 19 may further be modified as follows.

Figure 21:
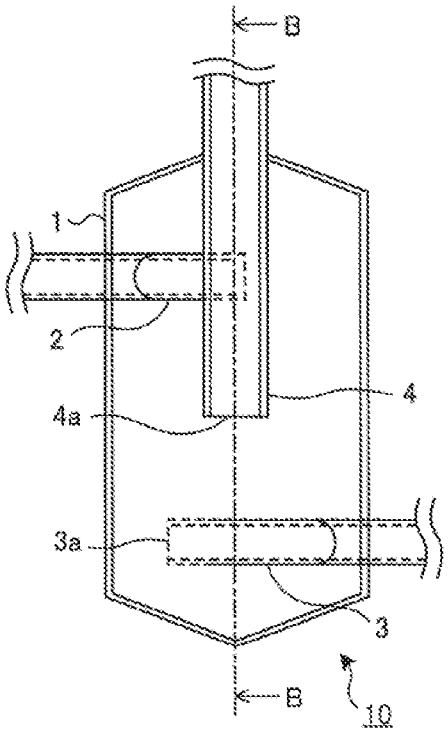
FIG. 21 is a sectional view illustrating a modification of the gas-liquid separator 10 included in the refrigeration cycle apparatus 200 according to Embodiment 6 of the present invention.
Figure 22:
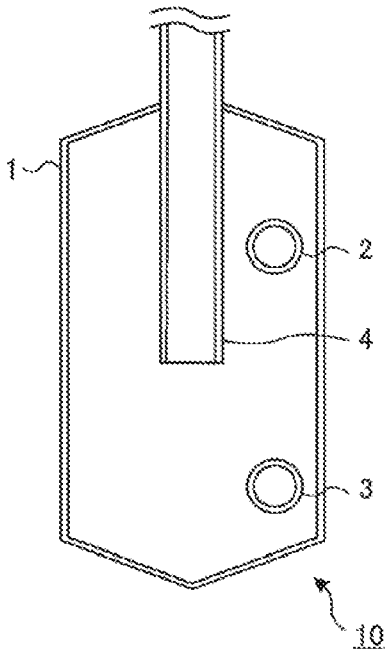
FIG. 22 is a sectional view taken along line B-B illustrated in FIG. 21.

FIG. 21 is a sectional view illustrating a modification of the gas-liquid separator 10 included in the refrigeration cycle apparatus 200 according to Embodiment 6 of the present invention. FIG. 22 is a sectional view taken along line B-B illustrated in FIG. 21.

In this modification, the liquid outflow pipe 3 is inserted into the container 1 from the side wall of the container 1. In this configuration, the liquid outlet 3*a* is also at a position not overlapping the gas outlet 4*a* of the gas outflow pipe 4 in plan view. In FIG. 21, the liquid outflow pipe 3 is inserted into the container 1 by such a length as to extend beyond the center line O of the container 1 in side view. Alternatively, the liquid outflow pipe 3 may be inserted by such a length as not to extend beyond the center line O of the container 1 in side view, as long as the liquid outlet 3*a* is at a position not overlapping the gas outlet 4*a* of the gas outflow pipe 4 in plan view.

Embodiment 7

Embodiment 7 relates to the gas outflow pipe 4 of the gas-liquid separator 10. The refrigeration cycle apparatus 200 is configured as in Embodiment 1. Now, Embodiment 7 will be described, focusing on differences from Embodiment 1.

Figure 23:
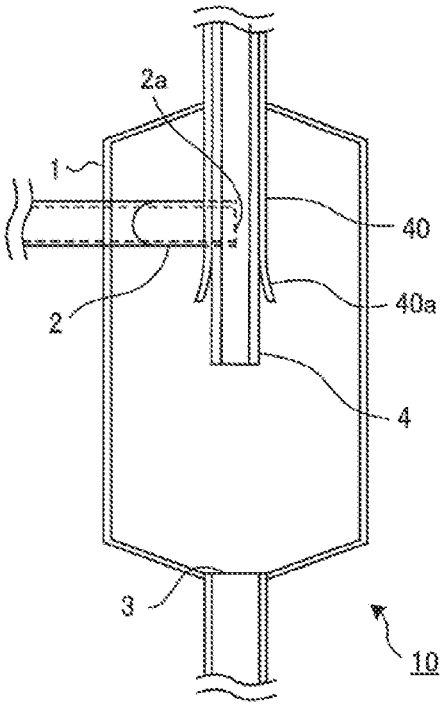
FIG. 23 is a sectional view of a gas-liquid separator 10 included in a refrigeration cycle apparatus 200 according to Embodiment 7 of the present invention.

FIG. 23 is a sectional view of a gas-liquid separator 10 included in a refrigeration cycle apparatus 200 according to Embodiment 7 of the present invention.

The gas-liquid separator 10 according to Embodiment 7 is characterized in additionally including an outer pipe 40 fitted over the gas outflow pipe 4. The outer pipe 40 is flared at a position lower than the inlet 2*a* of the inflow pipe 2. In other words, a flared surface 40*a* spreading outward toward the lower side is provided on the outer periphery of the gas outflow pipe 4 and at a position lower than the inlet 2*a* of the inflow pipe 2.

In such a configuration, liquid refrigerant that has flowed into the container 1 from the inlet 2*a* and liquid refrigerant that has struck upon the upper end of the container 1 run down the outer surface of the outer pipe 40 under the gravitational force and flows along the surface 40*a*. Since the surface 40*a* spreads outward toward the lower side, the liquid refrigerant flows in a direction toward the outer side from the center line O, that is, toward the wall surface in the container 1.

The effect of centrifugal force is greater on the side of the container 1 that is nearer to the wall than on the side nearer to the center line O. Therefore, the liquid refrigerant redirected along the surface 40*a* toward the wall of the container 1 receives a greater centrifugal force than in a configuration with no surface 40*a*. Hence, the centrifugal force applied to the liquid refrigerant on the surface 40*a* becomes greater than the surface tension of the liquid refrigerant on the surface 40*a*. Consequently, the liquid refrigerant is released from the surface 40*a* and flows toward the wall of the container 1, where a great centrifugal force acts on the liquid refrigerant flowing toward the wall of the container 1. Thus, the gas-liquid-separation efficiency is improved.

To summarize, according to Embodiment 7, the advantageous effects obtained in Embodiment 1 can also be obtained. Furthermore, since the gas outflow pipe 4 of the gas-liquid separator 10 has the flared surface 40*a* at a position lower than the inlet 2*a*, the following advantageous effect is obtained. The liquid refrigerant flowing downward along the outer surface of the outer pipe 40 under the gravitational force is redirected along the surface 40*a* toward the wall of the container 1, whereby a great centrifugal force can be applied to the liquid refrigerant. Consequently, the gas-liquid-separation efficiency can be improved.

Embodiment 8

Embodiment 8 relates to a method of controlling the opening degrees of the expansion devices 21 to 23 included in the refrigeration cycle apparatus 200. The gas-liquid separator 10 and the refrigeration cycle apparatus 200 are configured as in Embodiment 1. Now, Embodiment 8 will be described, focusing on differences from Embodiment 1.

Figure 24:
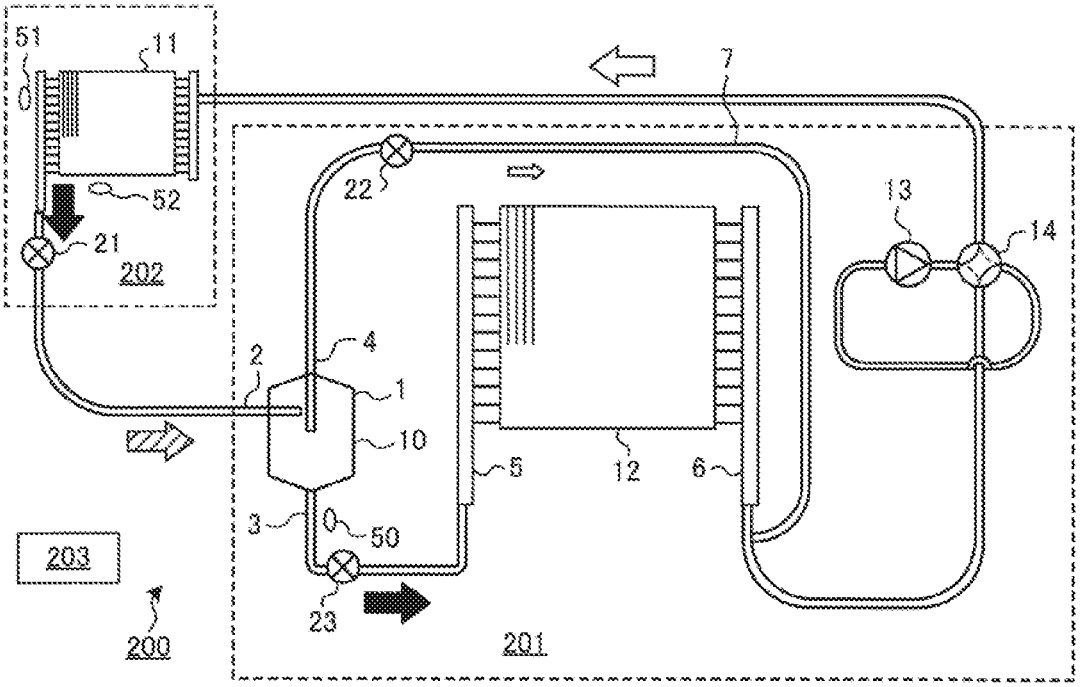
FIG. 24 is a diagram illustrating a configuration of a refrigeration cycle apparatus 200 according to Embodiment 8 of the present invention.

FIG. 24 is a diagram illustrating a configuration of a refrigeration cycle apparatus 200 according to Embodiment 8 of the present invention.

The refrigeration cycle apparatus 200 according to Embodiment 8 includes a plurality of temperature sensors 50 to 52, in addition to the elements included in the refrigeration cycle apparatus 200 according to Embodiment 1 illustrated in FIG. 1. The temperature sensor 50 measures a temperature (hereinafter referred to as liquid outlet temperature) TLS of the refrigerant discharged from the liquid outlet 3*a* of the gas-liquid separator 10. The temperature sensor 51 measures the temperature of the refrigerant at the outlet of the indoor heat exchanger 11, that is, a condenser outlet temperature TRout of the refrigerant in the heating operation. The temperature sensor 52 measures the temperature of the refrigerant flowing in the heat exchanger tubes of the indoor heat exchanger 11, that is, a condensation saturation temperature Tc in the heating operation. The temperature sensor 50 corresponds to the first temperature sensor according to the present invention, the temperature sensor 51 corresponds to the second temperature sensor according to the present invention, and the temperature sensor 52 corresponds to the third temperature sensor according to the present invention.

The controller 203 acquires the result of measurement of the temperature sensors 50 to 52 and controls relevant elements of the refrigeration cycle apparatus 200 in accordance with the measurement results and other relevant factors.

The controller 203 performs the heating operation and the cooling operation based on the result of measurement of the temperature sensors 50 to 52. Furthermore, to allow the individual indoor units 202 to satisfactorily exert the required air-conditioning capacity, the controller 203 determines a target condensing temperature in the heating operation or a target evaporating temperature in the cooling operation. In Embodiment 8, the target condensing temperature and the target evaporating temperature are each determined in accordance with a temperature difference $\Delta T$ between a preset temperature and the indoor-air temperature detected by a temperature sensor.

Then, the controller 203 controls the frequency of the compressor 13 such that the target evaporating temperature or the target condensing temperature is reached. Furthermore, the controller 203 controls the opening degree of the first expansion device 21 of the indoor unit 202 such that the degree of subcooling at the outlet of the indoor heat exchanger 11 in the heating operation or the degree of subcooling at the outlet of the outdoor heat exchanger 12 in the cooling operation becomes the target value.

In addition to the measurement results acquired through the temperature sensors 50 to 52, the controller 203 detects the number of indoor units 202 included and the frequency of the compressor 13 and controls the opening degrees of the expansion devices 21 to 23 in accordance with those pieces of data.

Now, changes in the gas-main region 100 and the liquid-main region 101 in the container 1 that occur in accordance with the operation of controlling the opening degrees of the first expansion device 21 and the third expansion device 23 will be described.

FIG. 25 is an exemplary graph illustrating changes in the gas-liquid-separation efficiency $\eta$ and in the liquid-surface height h that occur with changes in the opening degrees of the expansion devices 21 to 23 in the refrigeration cycle apparatus 200 according to Embodiment 8 of the present invention. In FIG. 25, the horizontal axis represents the opening degrees of the first expansion device 21 and the third expansion device 23, the right vertical axis represents the liquid-surface height h, and the left vertical axis represents the gas-liquid-separation efficiency $\eta$. Furthermore, in FIG. 25, the dotted line is a graph of the liquid-surface height h, and the solid line is a graph of the gas-liquid-separation efficiency $\eta$. FIGS. 6, 7, and 8 referred to above correspond to points (A), (B), and (C), respectively, illustrated in FIG. 25 and should also be referred to in the following description, in conjunction with FIG. 25.

As illustrated in FIG. 25, the first expansion device 21 and the third expansion device 23 are controlled such that when the opening degree of one of the two is raised, the opening degree of the other is lowered. At point (A) in FIG. 25, the opening degrees of the first expansion device 21 and the third expansion device 23 are set appropriately. In such a situation, as illustrated in FIG. 6, a satisfactory distance is provided between the gas outlet 4*a* of the gas outflow pipe 4 and the gas-liquid interface 102. Therefore, accidental flowing of the liquid into the gas outflow pipe 4 is prevented, and the reduction in the gas-liquid separability is suppressed.

In contrast, at point (B) in FIG. 25, the opening degree of the first expansion device 21 is lower than the appropriate opening degree, and the opening degree of the third expansion device 23 is higher than the appropriate opening degree. In such a situation, as illustrated in FIG. 7, the volume of the liquid-main region 101 in the container 1 is increased, and the liquid-surface height h goes up. Accordingly, the liquid refrigerant flows into the gas outflow pipe 4 from the gas outlet 4*a* of the gas outflow pipe 4, and the gas-liquid-separation efficiency $\eta$ is reduced.

On the other hand, at point (C) in FIG. 25, the opening degree of the first expansion device 21 is higher than the appropriate opening degree, and the opening degree of the third expansion device 23 is lower than the appropriate opening degree. In such a situation, as illustrated in FIG. 8, the volume of the gas-main region 100 in the container 1 is reduced. Accordingly, the liquid refrigerant flows into the gas outflow pipe 4 from the gas outlet 4*a* of the gas outflow pipe 4, and the gas-liquid-separation efficiency $\eta$ is reduced.

FIG. 26 is an exemplary table summarizing operations of opening and closing the expansion devices 21 to 23 in the refrigeration cycle apparatus 200 according to Embodiment 8 of the present invention.

As illustrated in FIG. 26, operations of controlling the opening degrees of the expansion devices 21 to 23 are roughly classified into two patterns: a heating only operation in which all of the indoor units 202 included in the refrigeration cycle apparatus 200 perform the heating operation, and a cooling only operation in which all of the indoor units 202 included in the refrigeration cycle apparatus 200 perform the cooling operation. The heating only operation is further classified into a heating operation under rated conditions ("rated" in FIG. 26) in which the capacity of the evaporator is 100%, and any other operation ("intermediate" in FIG. 26). In the "rated" operation, a refrigerant circulation amount $Gr_{now}$ [kg/h] is greater than $1.98(D_{inlet})^2$. In the "intermediate" operation, $Gr_{now}$ [kg/h] is smaller than or equal to $Gr_0$. Note that $Gr_0$[kg/h] is defined to be $1.98(D_{inlet})^2$.

<Operation of Controlling Expansion Devices in Heating Only Operation Under Rated Conditions>

Under such conditions, the opening degrees of the first expansion device 21, the second expansion device 22, and the third expansion device 23 are all "open" and are controlled appropriately. More specifically, the third expansion device 23 is first controlled such that the liquid outlet temperature TLS measured by the temperature sensor 50 is maintained to be within a predetermined temperature range. Furthermore, the first expansion device 21 is controlled such that the degree of subcooling at the outlet of the indoor heat exchanger 11 becomes a predetermined value.

As described above, the third expansion device 23 and the first expansion device 21 are controlled individually in accordance with the liquid outlet temperature TLS and the degree of subcooling, respectively. Consequently, the third expansion device 23 and the first expansion device 21 are controlled such that when the opening degree of one of the two is raised, the opening degree of the other is lowered, as described above. Specifically, for example, when the liquid outlet temperature TLS becomes lower, the opening degree of the third expansion device 23 is lowered, whereas the opening degree of the first expansion device 21 is raised. The pressure inside the container 1 is determined by the ratio between the opening degrees of the first expansion device 21 and the third expansion device 23, and the opening degree of the second expansion device 22.

Then, the second expansion device 22 is controlled, considering the balance relative to the third expansion device 23. For example, if the opening degree of the third expansion device 23 is raised, the opening degree of the second expansion device 22 is also raised. In such a control operation, the gas-liquid interface 102 in the gas-liquid separator 10 is adjusted, whereby the effect of improving the gas-liquid-separation efficiency is obtained.

<Operation of Controlling Expansion Devices in "Heating Only Operation Under Intermediate Conditions" and in "Cooling Only Operation">

Under the intermediate conditions, the compressor 13 operates at a predetermined rotational frequency or lower, and the refrigerant circulation amount $Gr_{now}$ [kg/h] is within a range of $0<Gr_{now}\leq 1.98(D_{inlet})^2$. Under such "intermediate" conditions and in the cooling only operation, as summarized in FIG. 26, the opening degree of the first expansion device 21 is controlled such that the degree of subcooling of the indoor heat exchanger 11 becomes a predetermined value. Furthermore, the opening degree of the second expansion device 22 is set to closed, and the opening degree of the third expansion device 23 is set to fully open. In this operation, since the second expansion device 22 is closed, the pressure inside the container 1 is determined by the ratio between the opening degrees of the first expansion device 21 and the third expansion device 23.

The range of $Gr_{now}$ for the intermediate conditions is defined as $0<Gr_{now}\leq 1.98(D_{inlet})^2$ on the basis of the following:

lower limit of $Gr_{now}$: over 0 kg/h during operation upper limit of $Gr_{now}$: An experiment has shown that, to obtain the effect of centrifugation, a mass velocity of $4Gr/3600/\pi/(D_{inlet}/1000)^2$ needs to be over 700 [kg/m$^2$·s]. Therefore, in the intermediate operation in which $Gr_{now}$ $1.98(D_{inlet})^2$ and the mass velocity is 700 [kg/m$^2$·s] or lower, the second expansion device 22 is fully closed, so that the gas-liquid separator 10 is not used as a gas-liquid separator.

Alternatively, the opening degree of the third expansion device 23 may be set to fully open, whereby the refrigerant may be supplied in the form of liquid refrigerant in a path from the refrigerant outlet of the outdoor unit 201 to the refrigerant inlet of the indoor unit 202. In such a control operation, if the refrigeration cycle apparatus 200 includes a plurality of indoor units 202, the refrigerant can be distributed in the form of a single liquid phase to the plurality of indoor units 202. Hence, the distribution of flow rate can be controlled easily.

In the actual control operation, tables summarizing optimum combinations of opening degrees of the first expansion device 21, the second expansion device 22, and the third expansion device 23 are prepared and stored in advance. The combinations are determined in accordance with the number of indoor units 202 included, the rotational frequency of the compressor 13, the pressure P in the gas-liquid separator 10, and the degree of subcooling of the indoor heat exchanger 11. The control operation is performed in accordance with the tables. That is, tables for the heating only operation under the rated conditions, the heating only operation under the intermediate conditions, and the cooling only operation may be stored.

To detect the pressure P in the gas-liquid separator 10, the temperature of the two-phase gas-liquid refrigerant discharged from the liquid outlet 3*a* of the gas-liquid separator 10 is measured by the temperature sensor 50, and the pressure P is calculated from the relationship between the temperature of the two-phase gas-liquid refrigerant and the pressure. The degree of subcooling of the indoor heat exchanger 11 is detected by subtracting the condenser outlet temperature TRout, which is measured by the temperature sensor 51, from the condensation saturation temperature Tc of the refrigerant, which is measured by the temperature sensor 52.

The operations of opening and closing the expansion devices 21 to 23 summarized in FIG. 26 are only exemplary. In a case where the refrigeration cycle apparatus 200 includes a plurality of indoor units 202 and performs a cooling-heating mixed operation in which some of the indoor units 202 perform the cooling operation while the others perform the heating operation, the expansion devices 21 to 23 may be controlled suitably for the individual operations.

To summarize, according to Embodiment 8, the advantageous effects obtained in Embodiment 1 can also be obtained. Furthermore, controlling the expansion devices 21 to 23 produces the following advantageous effect. The refrigerant pressure in the container 1 is adjusted by controlling the expansion devices 21 to 23, whereby the shape of the gas-liquid interface 102 is controlled appropriately. Hence, accidental flow of the liquid from the liquid-main region 101 into the gas outflow pipe 4 can be prevented.

Embodiment 9

In Embodiment 9, the third expansion device 23 included in the refrigeration cycle apparatus 200 is replaced with an expansion device whose amount of expansion is fixed. The other details of the refrigeration cycle apparatus 200 are the same as in Embodiment 1. The basic concept of controlling the opening degrees of the expansion devices is the same as in Embodiment 8. Now, Embodiment 9 will be described, focusing on differences from Embodiments 1 and 8.

FIG. 27 is a diagram illustrating a configuration of a refrigeration cycle apparatus 200 according to Embodiment 9 of the present invention.

In Embodiment 1 illustrated in FIG. 1, the third expansion device 23 is an expansion device whose opening degree is controllable. The refrigeration cycle apparatus 200 according to Embodiment 9 includes a third expansion device 24 whose amount of expansion is fixed. The fixed expansion device is specifically a capillary tube, or a header serving as a refrigerant distributor, for example. The flow resistance of the fixed expansion device may be provided in the form of, for example, flow-path pressure loss in the refrigerant pipe or pressure loss by bending, instead of contraction by a restrictor.

FIG. 28 is an exemplary table summarizing operations of opening and closing the expansion devices 21, 22, and 24 in the refrigeration cycle apparatus 200 according to Embodiment 9 of the present invention.

<Operation of Controlling Expansion Devices in Heating Only Operation Under Rated Conditions>

In Embodiment 8, the third expansion device 23 provided at the liquid outlet of the gas-liquid separator 10 is controlled such that the liquid outlet temperature TLS measured by the temperature sensor 50 is maintained to be within a predetermined temperature range. In Embodiment 9, however, the third expansion device 24 provided at the liquid outlet of the gas-liquid separator 10 is a fixed expansion device, and the adjustment of the liquid outlet temperature TLS by controlling the opening degree of the third expansion device 24 is impossible. Therefore, the degree of subcooling at the outlet of the indoor heat exchanger 11 is controlled by using the first expansion device 21 and the second expansion device 22. Specifically, in accordance with the temperatures measured by the temperature sensor 51 and the temperature sensor 52, respectively, the first expansion device 21 and the second expansion device 22 are controlled such that the degree of subcooling becomes the target value. For example, a case where the quality of the refrigerant flowing into the gas-liquid separator 10 in the heating operation is 0.05 to 0.30 and the frequency of the compressor 13 is a particular value or higher or the number of indoor units 202 is over a particular value applies to an operation under the rated conditions.

Methods of controlling the first expansion device 21, the second expansion device 22, and the third expansion device 24 in the "heating only operation under intermediate conditions" and in the "cooling only operation" are the same as in Embodiment 8 summarized in FIG. 26, except that the amount of expansion by the third expansion device 24 is fixed.

To summarize, according to Embodiment 9, the advantageous effects obtained in Embodiment 1 can also be obtained. Furthermore, since the amount of expansion by the third expansion device 24 is fixed, the third expansion device 24 does not need to be controlled. Therefore, the restriction on the configuration of the pipe provided between the liquid outlet 3*a* of the gas-liquid separator 10 to the inlet header 5 of the indoor heat exchanger 11 is eased. The reason for this is as follows. If the third expansion device 24 is a valve, such as an expansion valve, whose opening degree is controllable as in Embodiment 1, a restriction on the pipe configuration arises in that, for example, the direction in which the refrigerant flows into the expansion valve is limited to a vertically upward direction for assured opening-degree controllability. However, since the third expansion device 24 as a fixed expansion device is employed, such a restriction is unnecessary. That is, the restriction on the pipe configuration is eased, making it easier to install the refrigerant circuit into the housing of the outdoor unit 201.

Alternatively, the third expansion device 24 may be replaced with a capillary tube, a refrigerant pipe, or the inlet header 5 of the outdoor heat exchanger 12, and the function of the restrictor may be provided in the form of, for example, frictional pressure loss in the refrigerant pipe or impact pressure loss. With the third expansion device 24 having such a configuration, the pipe configuration between the liquid outlet 3*a* of the gas-liquid separator 10 and the inlet header 5 of the outdoor heat exchanger 12 can be simplified, realizing a cost reduction. Furthermore, the refrigerant pipes can be easily installed in the outdoor unit 201.

While Embodiments 1 to 9 have been described as different embodiments, the refrigeration cycle apparatus 200 may be obtained by combining individual features of Embodiments 1 to 9 in any way. Moreover, each of the modifications applied to features that are common to Embodiments 1 to 9 may also be applied to any of Embodiments 1 to 9 that is not described for that modification.

REFERENCE SIGNS LIST

1 container 2 inflow pipe 2A insertion portion 2B bent portion 2C inflow portion 2*a* inlet 3 liquid outflow pipe 3*a* liquid outlet 4 gas outflow pipe 4*a* gas outlet 5 inlet header 6 outlet header 7 bypass 10 gas-liquid separator 11 indoor heat exchanger 12 outdoor heat exchanger 13 compressor 14 four-way valve 15 refrigerant tank 21 first expansion device 22 second expansion device 23 third expansion device 24 third expansion device 30*a* pipe 30*b* pipe 31 first switching valve 32 second switching valve 33 third switching valve 34 fourth switching valve 40 outer pipe 40*a* surface 50 temperature sensor 51 temperature sensor 52 temperature sensor 100 gas-main region 101 liquid-main region 102 gas-liquid interface 200 refrigeration cycle apparatus 201 outdoor unit 202 indoor unit 203 controller.

The invention claimed is:

1. A refrigeration cycle apparatus comprising:

a main circuit through which refrigerant circulates and in which a compressor, a condenser, a first expansion device, a centrifugal gas-liquid separator that separates refrigerant into gas refrigerant and liquid refrigerant by using centrifugal force, and an evaporator are connected by refrigerant pipes; and a bypass, including a gas outflow pipe, through which the gas refrigerant obtained through the separation by the gas-liquid separator is returned to a suction side of the compressor, wherein the gas-liquid separator includes a cylindrical container, an inflow pipe, the gas outflow pipe, and a liquid outflow pipe, wherein the main circuit includes a third expansion device provided between the liquid outflow pipe of the gas-liquid separator and the evaporator, and wherein the gas refrigerant discharged from the gas outflow pipe of the gas-liquid separator flows into the bypass, and the bypass includes a second expansion device, wherein, in the gas-liquid separator, the inflow pipe is inserted through an upper part of a side wall of the container, and the gas outflow pipe extends vertically through a central part of an upper wall of the container, wherein $0.26H_1 \leq L_1 \leq 0.65H_1$ is satisfied where $H_1$ is a height of the container and $L_1$ is a gas-outflow-pipe insertion length representing a length of insertion of the gas outflow pipe from an upper end of the container, and wherein $0.25H_1 < L_1 - H_2$ is satisfied where $L_1 - H_2$ is a difference obtained by subtracting a vertical distance $H_2$ from the upper end of the container to a gas outlet of the gas outflow pipe from the gas-outflow-pipe insertion length $L_1$.

2. The refrigeration cycle apparatus of claim 1, wherein:

the refrigeration cycle apparatus is structured such that $0 < D_{inlet} < (0.71Gr^{0.5})$ and $D_{inlet} < D_{bottle}/2$ are satisfied where $D_{bottle}$ (mm) is an inside diameter of the container and Gr (kg/h) is a refrigerant mass flow rate in a rated heating operation, $D_{inlet}$ (mm) is an in-pipe equivalent diameter of the inflow pipe.

3. The refrigeration cycle apparatus of claim 1, wherein:

the inflow pipe of the gas-liquid separator has a shape bent at a position outside the container, the inflow pipe includes an insertion portion at a first end which is positioned inside the container, and the insertion portion includes, a bent portion extending from a second end of the insertion portion, and an inflow portion extending from a tip of the bent portion.

4. The refrigeration cycle apparatus of claim 3, wherein:

$0 < L_2 < 15 * D_{inlet}$ is satisfied where $L_2$ is a length of the insertion portion of the inflow pipe, and $D_{inlet}$ is a diameter of the inflow pipe.

5. The refrigeration cycle apparatus of claim 3, wherein an orthogonal coordinate system is defined in a plane that is vertical to a center axis of the insertion portion, with an origin being a point of intersection of the plane and the center axis, an x axis is defined as a vertical line extending from the origin toward a lower side in a direction of gravitational force, the x axis being positive toward the lower side in the direction of gravitational force, and a y axis extends on left and right sides of a plane containing the center axis and the x axis, they axis being positive toward a side of the origin on which a center line of the container is positioned; and wherein the inflow portion is positioned in a first quadrant defined on the positive side of the x axis and on the positive side of they axis, or in which x>0 and y>0.

6. The refrigeration cycle apparatus of claim 5, wherein the inflow portion rises obliquely toward the bent portion, and the inner peripheral side of the bent portion is closer to the side of the container than the outer peripheral side of the bent portion, and the insertion portion is straight from the bend portion side end of the insertion portion to the end of the insert portion which is positioned inside the container.

7. The refrigeration cycle apparatus of claim 1, wherein the gas-liquid separator has a liquid outlet, and wherein, in plan view, the liquid outlet is provided at a position not overlapping a gas outlet, the gas outlet being provided at a container-side end of the gas outflow pipe.

8. The refrigeration cycle apparatus of claim 7, wherein the gas-liquid separator includes the liquid outflow pipe connected to a bottom part of a side wall of the container or to a bottom wall of the container, and wherein the liquid outlet is provided at a container-side end of the liquid outflow pipe.

9. The refrigeration cycle apparatus of claim 1, wherein, in the gas-liquid separator, a flared surface spreading outward toward a lower side is provided on an outer periphery of the gas outflow pipe and at a position lower than an inlet from which the refrigerant flows into the gas-liquid separator.

10. The refrigeration cycle apparatus of claim 1, wherein the container of the gas-liquid separator has a conical shape projecting downward in a direction of gravitational force.

11. The refrigeration cycle apparatus of claim 1, wherein the first expansion device, the second expansion device, and the third expansion device are controlled such that the liquid refrigerant accumulated in the gas-liquid separator is not discharged from a gas outlet of the gas-liquid separator.

12. The refrigeration cycle apparatus of claim 11, wherein:

the refrigeration cycle apparatus is structured such that when an opening degree of the first expansion device increases, opening degrees of the second expansion device and the third expansion device decreases.

13. The refrigeration cycle apparatus of claim 1, wherein the third expansion device is a fixed expansion device whose amount of expansion is fixed.

14. The refrigeration cycle apparatus of claim 13, wherein the third expansion device is a capillary tube, a refrigerant pipe, or a header.

15. The refrigeration cycle apparatus of claim 1, wherein the refrigerant cycle apparatus is structured such that the second expansion device is closed when $0 < Gr_{now} \leq 1.98(D_{inlet})^2$ is satisfied where $D_{inlet}$ (mm) is an in-pipe equivalent diameter of the inflow pipe and $Gr_{now}$ (kg/h) is a refrigerant circulation amount of the main circuit.

16. The refrigeration cycle apparatus of claim 1, further comprising an indoor unit including an indoor heat exchanger serving as the condenser, and an outdoor unit including an outdoor heat exchanger serving as the evaporator.

17. The refrigeration cycle apparatus of claim 16, further comprising:

a four-way valve that switches an operation between a heating operation and a cooling operation by switching a flow of the refrigerant in the main circuit, wherein the indoor heat exchanger serves as the evaporator and the outdoor heat exchanger serves as the condenser in the cooling operation, and wherein the third expansion device is fully open in the cooling operation.

18. A refrigeration cycle apparatus comprising:

a main circuit through which refrigerant circulates and in which a compressor, a condenser, a first expansion device, a centrifugal gas-liquid separator that separates refrigerant into gas refrigerant and liquid refrigerant by using centrifugal force, and an evaporator are connected by refrigerant pipes; and a bypass, including a gas outflow pipe, through which the gas refrigerant obtained through the separation by the gas-liquid separator is returned to a suction side of the compressor, wherein the gas-liquid separator includes a cylindrical container, an inflow pipe, the gas outflow pipe, and a liquid outflow pipe, wherein the main circuit includes a third expansion device provided between the liquid outflow pipe of the gas-liquid separator and the evaporator, and wherein the gas refrigerant discharged from the gas outflow pipe of the gas-liquid separator flows into the bypass, and the bypass includes a second expansion device, wherein the first expansion device, the second expansion device, and the third expansion device are controlled such that the liquid refrigerant accumulated in the gas-liquid separator is not discharged from a gas outlet of the gas-liquid separator, the refrigeration cycle apparatus further comprising:

a first temperature sensor that measures a temperature of the refrigerant discharged from a liquid outlet of the gas-liquid separator, a second temperature sensor that measures a temperature of the refrigerant at an outlet of the condenser, and a third temperature sensor that measures an evaporating temperature of the evaporator, wherein the first expansion device, the second expansion device, and the third expansion device are controlled based on a frequency of the compressor and results of measurements by the temperature sensors.

19. A refrigeration cycle apparatus comprising:

a main circuit through which refrigerant circulates and in which a compressor, a condenser, a first expansion device, a centrifugal gas-liquid separator that separates refrigerant into gas refrigerant and liquid refrigerant by using centrifugal force, and an evaporator are connected by refrigerant pipes; and a bypass, including a gas outflow pipe, through which the gas refrigerant obtained through the separation by the gas-liquid separator is returned to a suction side of the compressor, wherein the gas-liquid separator includes a cylindrical container, an inflow pipe, the gas outflow pipe, and a liquid outflow pipe, wherein the main circuit includes a third expansion device provided between the liquid outflow pipe of the gas-liquid separator and the evaporator, and wherein the gas refrigerant discharged from the gas outflow pipe of the gas-liquid separator flows into the bypass, and the bypass includes a second expansion device, the refrigeration cycle apparatus further comprising an indoor unit including an indoor heat exchanger serving as the condenser, and an outdoor unit including an outdoor heat exchanger serving as the evaporator, wherein the indoor unit comprises a plurality of indoor units, and wherein the first expansion device, the second expansion device, and the third expansion device are controlled based on a number of indoor units included, a frequency of the compressor, and results of measurements by temperature sensors.

20. The refrigeration cycle apparatus of claim 19, wherein the second expansion device is closed in a cooling only operation in which a plurality of outdoor units perform the cooling operation.

21. The refrigeration cycle apparatus of claim 19, wherein the third expansion device is fully open in a cooling only operation in which a plurality of outdoor units perform the cooling operation.

* * * * *